US008744288B2

(12) United States Patent
Shinoya et al.

(10) Patent No.: US 8,744,288 B2
(45) Date of Patent: Jun. 3, 2014

(54) CARTRIDGE

(75) Inventors: Shota Shinoya, Nagoya (JP); Masatoshi Shiraki, Nagoya (JP); Fumikazu Sato, Konan (JP); Naoto Ozeki, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 156 days.

(21) Appl. No.: 13/430,950

(22) Filed: Mar. 27, 2012

(65) Prior Publication Data

US 2012/0321345 A1 Dec. 20, 2012

(30) Foreign Application Priority Data

Apr. 28, 2011 (JP) ..... 2011-100507

(51) Int. Cl.
*G03G 15/00* (2006.01)
*G03G 21/16* (2006.01)
*G03G 21/18* (2006.01)

(52) U.S. Cl.
CPC ..... *G03G 21/16* (2013.01); *G03G 21/1857* (2013.01); *G03G 21/1896* (2013.01)
USPC ..... 399/25; 399/119

(58) Field of Classification Search
CPC ..... G03G 21/1857; G03G 21/1896
USPC ..... 399/25
See application file for complete search history.

(56) References Cited

U.S. PATENT DOCUMENTS

| | | | | |
|---|---|---|---|---|
| 6,792,217 | B2 * | 9/2004 | Nishino et al. | 399/12 |
| 7,418,214 | B2 * | 8/2008 | Yoshida et al. | 399/12 |
| 7,463,834 | B2 * | 12/2008 | Takagi et al. | 399/12 |
| 7,509,075 | B2 * | 3/2009 | Hayakawa | 399/167 |
| 7,512,347 | B2 | 3/2009 | Suzuki et al. | |
| 8,463,145 | B2 * | 6/2013 | Ukai et al. | 399/12 |
| 2006/0193646 | A1 | 8/2006 | Suzuki et al. | |

(Continued)

FOREIGN PATENT DOCUMENTS

| | | |
|---|---|---|
| CN | 201170840 Y | 12/2008 |
| CN | 201222170 Y | 4/2009 |

(Continued)

OTHER PUBLICATIONS

CN Office Action mailed Sep. 30, 2013, CN App. 201210083716.3, English translation.

(Continued)

*Primary Examiner* — David Gray
*Assistant Examiner* — Geoffrey Evans
(74) *Attorney, Agent, or Firm* — Banner & Witcoff, Ltd.

(57) ABSTRACT

A cartridge including: a housing including a first side wall and a second side wall which are opposed to each other; a driving input member provided to the first side wall and is configured to rotate; and a first rotary member provided at an outer side of the first side wall and is configured to rotate about a first rotational axis in response to a rotational driving force from the driving input member, wherein the first rotary member includes a protrusion protruding to the outer side, wherein the first rotary member is configured to be moved relative to the first side wall in a direction along the first rotational axis, and wherein an end portion of the first rotary member at an opposite side of the first side wall is configured to be displaced in a direction crossing the first rotational axis.

16 Claims, 24 Drawing Sheets

(56) References Cited

U.S. PATENT DOCUMENTS

| | | | | |
|---|---|---|---|---|
| 2007/0140725 | A1* | 6/2007 | Kamimura | 399/90 |
| 2012/0177398 | A1* | 7/2012 | Takigawa | 399/111 |
| 2012/0251165 | A1* | 10/2012 | Mushika et al. | 399/110 |
| 2012/0251216 | A1* | 10/2012 | Mushika | 400/352 |
| 2013/0051813 | A1* | 2/2013 | Itabashi et al. | 399/12 |
| 2013/0051814 | A1* | 2/2013 | Itabashi et al. | 399/12 |
| 2013/0051815 | A1* | 2/2013 | Itabashi et al. | 399/12 |
| 2013/0051816 | A1* | 2/2013 | Itabashi | 399/12 |
| 2013/0051833 | A1* | 2/2013 | Itabashi et al. | 399/90 |
| 2013/0084083 | A1* | 4/2013 | Itabashi et al. | 399/12 |
| 2013/0136460 | A1* | 5/2013 | Shiraki et al. | 399/12 |
| 2013/0259528 | A1* | 10/2013 | Yamamoto | 399/167 |

FOREIGN PATENT DOCUMENTS

| | | | |
|---|---|---|---|
| CN | 201464807 | | 5/2010 |
| JP | H08-248838 | A | 9/1996 |
| JP | 2001-042585 | A | 2/2001 |
| JP | 2006-267994 | | 10/2006 |
| JP | 2011-013323 | A | 1/2011 |

OTHER PUBLICATIONS

JP Office Action mailed Nov. 19, 2013, JP Appln. 2013-103770, English translation.

* cited by examiner

CARTRIDGE

CROSS-REFERENCE TO RELATED APPLICATIONS

This application claims priority from Japanese Patent Application No. 2011-100507 filed on Apr. 28, 2011, the entire contents of which are incorporated herein by reference.

TECHNICAL FIELD

Aspects of the present invention relate to a cartridge for an image forming apparatus such as a laser printer.

BACKGROUND

In an example of a laser printer, a developing cartridge is mounted in an apparatus body. Toner is accommodated in the developing cartridge. The toner in the developing cartridge is used to form an image on sheet. If there is no toner in the developing cartridge, the developing cartridge is removed from the apparatus body and a new developing cartridge is mounted in the apparatus body. Further, when sheet jam occurs in the apparatus body, the developing cartridge is removed from the apparatus body. And, after the sheet jam is solved, the developing cartridge is mounted again in the apparatus body.

In order to determine the service life of the developing cartridge, a technique for determining whether the developing cartridge mounted in the apparatus body is a new product or an old product has been proposed.

A detecting gear is provided to a side surface of the developing cartridge. The detecting gear is configured to rotate about an axis (rotational axis) extending in a direction perpendicular to the side surface. The detecting gear includes a plate-shaped detecting gear body and an abutting protrusion integrally formed with the detecting gear body. Herein, the abutting protrusion is provided outside (an opposite side of the developing cartridge's side surface relative to the detecting gear body) of the detecting gear body. The detecting gear body is provided with gear teeth over a partial peripheral surface thereof.

Further, a transmitting gear is provided to the side surface of the developing cartridge. The transmitting gear is configured to rotate about an axis extending parallel to and spaced apart from the axis of the detecting gear. The transmitting gear is integrally rotated together with an agitator for agitating the toner in the developing cartridge. The transmitting gear includes gear teeth over an entire peripheral surface thereof.

In a new developing cartridge, the gear teeth of the transmitting gear is engaged with the gear teeth of the detecting gear. When the developing cartridge is mounted in the apparatus body, a driving force of the motor is inputted to the transmitting gear and then transmitted from the transmitting gear to the detecting gear owing to the engagement between the gear teeth of the transmitting gear and the gear teeth of the detecting gear.

Therefore, the detecting gear rotates and the abutting protrusion moves in a rotational direction of the detecting gear in accordance with the rotation of the detecting gear. When the detecting gear is continuously rotated and a part of the detecting gear without teeth is opposed to the gear teeth of the transmitting gear, the engagement between the gear teeth of the transmitting gear and the gear teeth of the detecting gear is released and thus the detecting gear stops rotating. Accordingly, when the developing cartridge has been mounted in the apparatus body at least once, the engagement between the gear teeth of the transmitting gear and the gear teeth of the detecting gear is released and this state is maintained.

A sensor for detecting passing of the abutting protrusion as a detected protrusion is provided in the apparatus body. It is determined whether the developing cartridge is a new product or an old product, based on the detecting result of the sensor. That is, when the developing cartridge is mounted in the apparatus body and then the sensor detects the passing of the abutting protrusion, it is determined that the developing cartridge is a new product. On the contrary, when the developing cartridge is mounted in the apparatus body and then the sensor does not detect the passing of the abutting protrusion, it is determined that the developing cartridge is an old product (Refer to, for example, JP-A-2006-267994).

SUMMARY

However, when the developing cartridge is attached to or detached from the apparatus body or when the developing cartridge is separated from the apparatus body and transported, there is a risk that the abutting protrusion is worn by rubbing with other components. Further, there is a risk that the abutting protrusion and/or other components can be damaged, due to contact or engagement of the abutting protrusion and other components.

The object of aspects of the present invention is to provide a cartridge capable of reducing the wear on the detected protrusion.

According to an aspect of the invention, there is provided a cartridge including: a housing including a first side wall and a second side wall which are opposed to each other and accommodating developer therein; a driving input member provided to the first side wall and is configured to rotate by a rotational driving force inputted from the outside; and a first rotary member provided at an outer side of the first side wall and is configured to rotate about a first rotational axis in response to a rotational driving force from the driving input member, wherein the first rotary member includes a protrusion protruding to the outer side, wherein the first rotary member is configured to be moved relative to the first side wall in a direction along the first rotational axis, and wherein an end portion of the first rotary member at an opposite side of the first side wall is configured to be displaced in a direction crossing the first rotational axis.

According thereof, the driving input member is provided to the first side wall of the housing of the cartridge. The driving input member is rotated by the rotational driving force inputted from the outside. As the driving input member rotates, the rotational driving force is outputted from the driving input member.

The cartridge includes a first rotary member rotating in response to the rotational driving force outputted from the driving input member. The first rotary member has a detected protrusion protruding outward. And, the first rotary member is provided at the outer side of the first side wall and is configured to be moved relative to the first side wall in a direction along the first rotational axis and to allow an end portion thereof at an opposite side of the first side wall to be displaced in a direction crossing the first rotational axis.

Therefore, when other components contact the detected protrusion to apply a force to the detected protrusion during the transportation of the cartridge, the first rotary member is displaced in a direction along the first rotational axis and/or a direction crossing the first rotational axis. Accordingly, it is possible to prevent a strong force from being applied to the detected protrusion and to reduce the wear on the detected protrusion. Further, the force applied to the detected protrusion can be relieved and thus the damage to the detected protrusion can be alleviated.

According to another aspect of the invention, there is provided a cartridge including: a housing accommodating developer therein, the housing including, a first side all and a second side wall which is opposed to a first surface of the first side wall; a driving input member provided to the first side wall and is configured to rotate; a first rotary member opposed to a second surface of the first side wall, which is opposite to the first surface of the first side wall, at a first surface thereof, and is configured to rotate about a first rotational axis in response to a rotational driving force from the driving input member, the first rotational axis being substantially perpendicular to the first side wall; and a protrusion protruding from a second surface of the first rotary member, which is opposite to the first surface of the first rotary member, wherein the first rotary member is configured to be moved relative to the first side wall in a direction substantially parallel to the first rotational axis, and wherein the first rotary member is configured to be displaced in a direction crossing the first rotational axis.

DETAILED DESCRIPTION

Hereinafter, exemplary embodiments of the present invention will be described in detail by referring to accompanying drawings.

First Exemplary Embodiment

1. Overall Configuration of a Laser Printer

Figure 1:
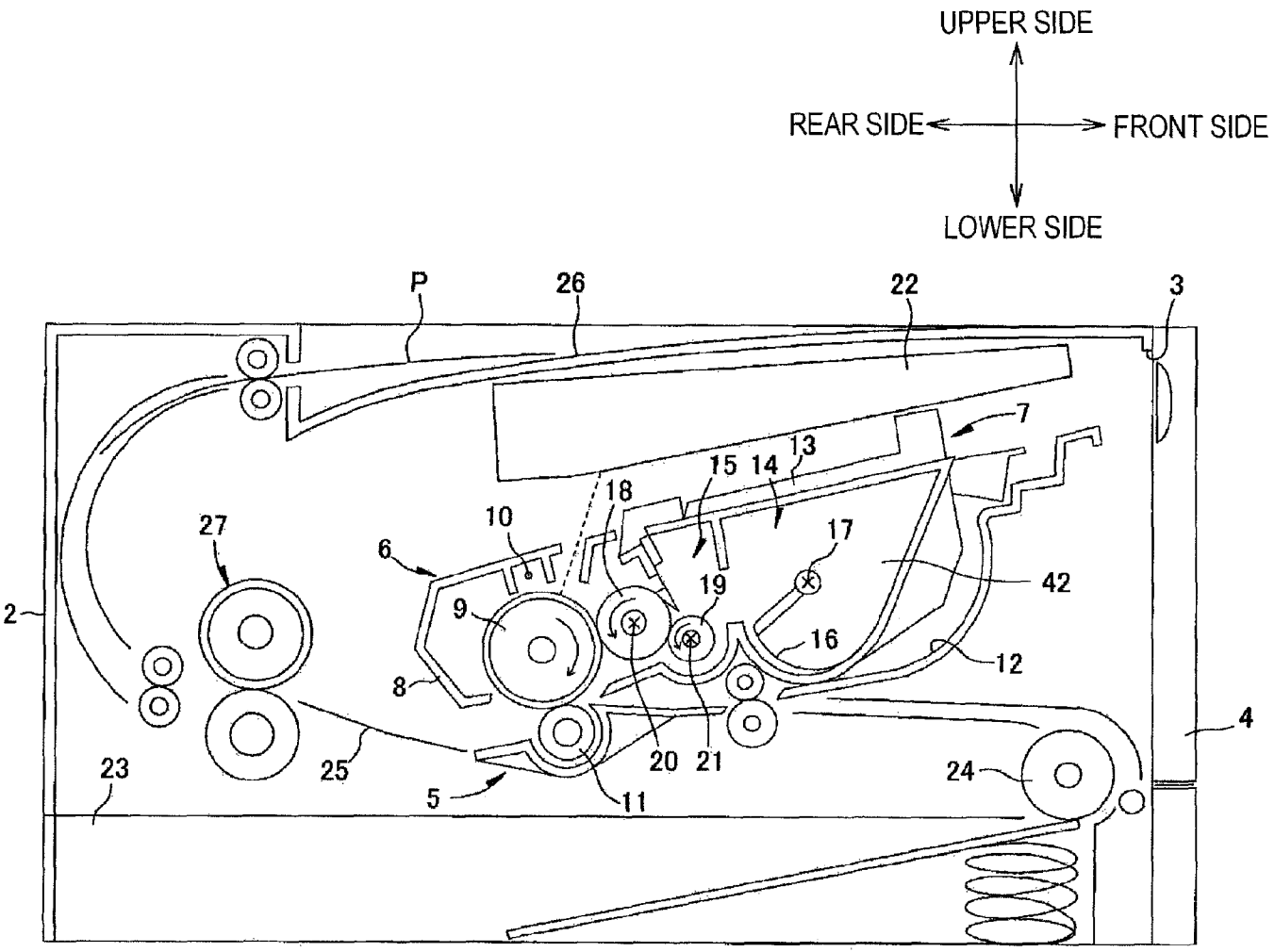
FIG. 1 is a sectional view of a laser printer equipped with a developing cartridge according to one exemplary embodiment of the present invention.

As illustrated in FIG. 1, the laser printer 1 includes a body casing 2 (apparatus body). A front side wall of the body casing 2 includes a cartridge removable opening 3 and a front cover 4 for opening and closing the cartridge removable opening 3.

It should be noted that the front face side of the laser printer 1 is referred to the front side in a front-rear direction. Further, an upper-lower direction and a left-right direction of the laser printer 1 and the developing cartridge 7 are defined by viewing the laser printer 1 which is placed on a plane and a developing cartridge 7 (described later) which is mounted in the body casing 2 of the laser printer 1 from the front side of the laser printer and the developing cartridge.

A process cartridge 5 is mounted slightly in front of the center portion in the body casing 2. The process cartridge 5 can be mounted to the body casing 2 and separated from the body casing 2 through the cartridge removable opening 3 when the front cover 4 is opened.

The process cartridge 5 includes a drum cartridge 6 and the developing cartridge 7 as an example of a cartridge which is detachably mounted to the drum cartridge 6.

The drum cartridge 6 includes a drum frame 8. A photosensitive drum 9 is rotatably retained on a rear end of the drum frame 8. Further, a charger 10 and a transfer roller 11 are retained on the drum frame 8. The charger 10 and the transfer roller 11 are respectively disposed upper to and lower to the photosensitive drum 9.

A part of the drum frame 8 which is placed in front of the photosensitive drum 9 is referred to as a cartridge mounting part 12. The developing cartridge 7 is mounted to the cartridge mounting part 12.

The developing cartridge 7 includes a housing 13 which accommodates toner. A toner accommodating chamber 14 and a developing chamber 15 are formed in the housing 13 and are disposed adjacent to each other in a front-rear direction while being communicated to each other.

An agitator 16 is provided in the toner accommodating chamber 14 so as to rotate about a rotational axis 17 of the agitator extending in a left-right direction. As the agitator 16 rotates, the toner accommodated in the toner accommodating chamber 14 is agitated and transmitted from the toner accommodating chamber 14 to the developing chamber 15.

A developing roller 18 and a supply roller 19 are provided in the developing chamber 15 so as to rotate about a rotational axis 20 of the developing roller and a rotational axis 21 of the supply roller respectively extending in a left-right direction.

The developing roller 18 is arranged so that a portion of the peripheral surface thereof is exposed from the rear end of the housing 13. The developing cartridge 7 is mounted to the drum cartridge 6 so as to allow the peripheral surface of the developing roller 18 to contact the peripheral surface of the photosensitive drum 9.

The supply roller 19 is arranged so that the peripheral surface thereof contacts the peripheral surface of the developing roller 18 from the front lower side. The toner in the developing chamber 15 is supplied to the peripheral surface of the developing roller 18 by the supply roller 19 and carried in a thin layer on the peripheral surface of the developing roller 18.

Further, an exposure unit 22 having a laser is arranged upper to the process cartridge 5 in the body casing 2.

During an image forming operation, the photosensitive drum 9 rotates at a constant speed in a clockwise direction, as viewed from the left side. As the photosensitive drum 9 rotates, the peripheral surface (surface) of the photosensitive drum 9 is uniformly charged with the discharge of the charger 10. Meanwhile, the exposure unit 22 is controlled based on image data and a laser beam is emitted from the exposure unit 22. For example, the laser printer 1 is connected to a personal computer (not illustrated) and the image data is transmitted from the personal computer to the laser printer 1. The laser beam passes through the charger 10 and the developing cartridge 7 and is irradiated over the uniformly charged peripheral surface of the photosensitive drum 9 to selectively expose the peripheral surface of the photosensitive drum 9. Charges are selectively removed from the exposed portion of the photosensitive drum 9 by such an exposure to form an electrostatic latent image on the peripheral surface of the photosensitive drum 9. When the photosensitive drum 9 rotates to cause the electrostatic latent image to be opposed to the developing roller 18, the toner is supplied from the developing roller 18 to the electrostatic latent image to develop the electrostatic latent image into a toner image.

A sheet feeding tray 23 accommodating sheet P is arranged in a bottom portion of the body casing 2. A pickup roller 24 is provided upper to the sheet feeding tray 23 for feeding sheet from the sheet feeding tray 23.

Further, a conveying path 25 having S-shape as viewed from the side is formed in the body easing 2. This conveying path 25 extends from the sheet feeding tray 23 to a sheet discharge tray 26 through between the photosensitive drum 9 and the transfer roller 11. The sheet discharge tray 26 is formed to an upper surface of the body casing 2.

Owing to the action of a bias supplied to the transfer roller 11, the toner image on the peripheral surface of the photosensitive drum 9 is transferred on the sheet P passing through between the photosensitive drum 9 and the transfer roller 11.

A fixing unit 27 is provided upper to the conveying path 25 at a position downstream the transfer roller 11 in the feeding direction of the sheet P. The toner image is transferred on the sheet P and this sheet P is conveyed on the conveying path 25 and passes over the fixing unit 27. In the fixing unit 27, the toner image is subjected to heat and pressure and a printed image is formed and is fixed on the sheet P. In this way, the sheet P having the printed image is further conveyed in the conveying path 25 and discharged on the sheet discharge tray 26.

2. Developing Cartridge

2-1. Housing

Figure 2:
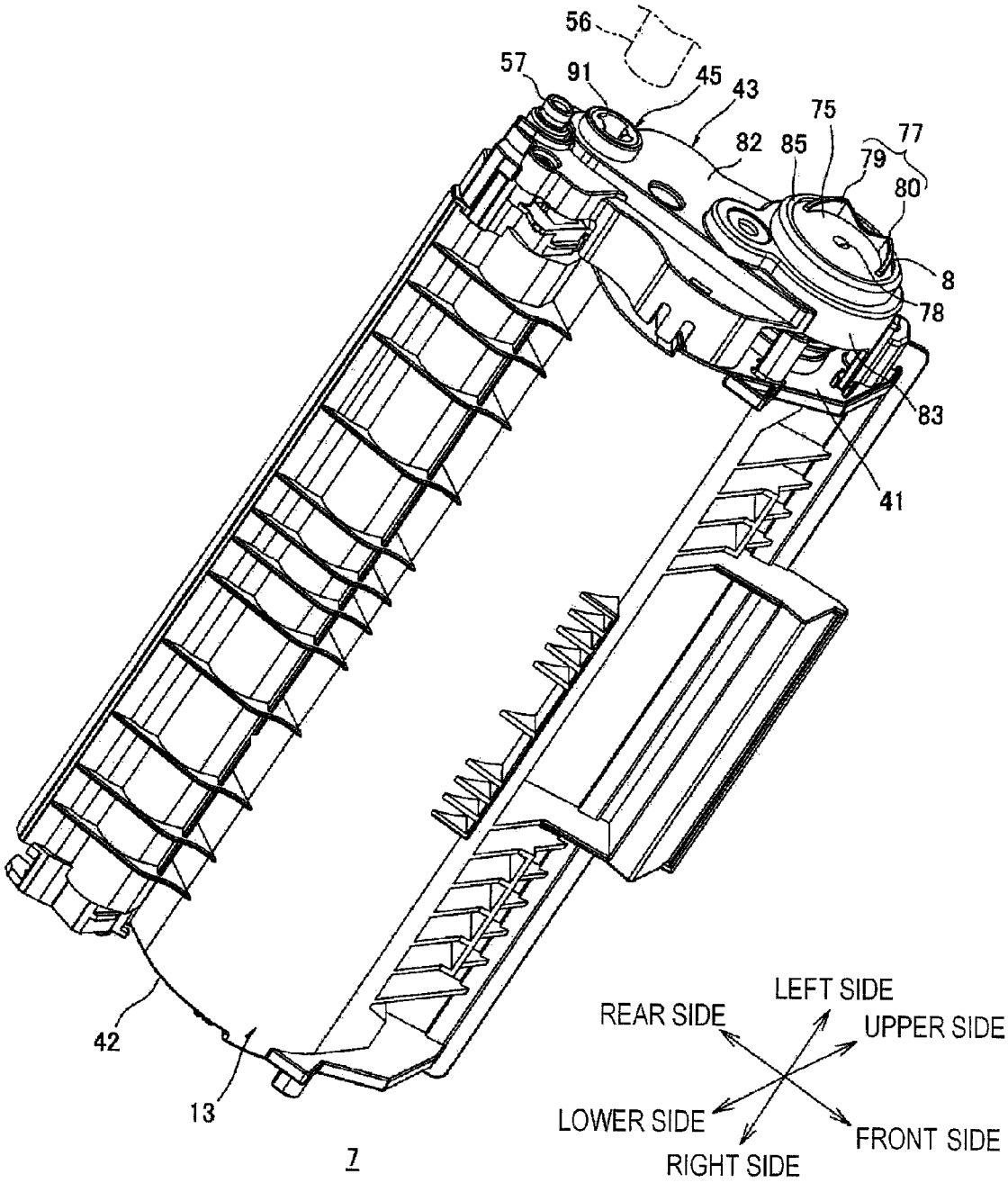
FIG. 2 is a perspective view of the developing cartridge as viewed from the lower left side thereof.

The housing 13 of the developing cartridge 7 includes a first side wall 41 (see, FIG. 2) and a second side wall 42 (see, FIG. 1) which are laterally spaced apart and opposed to each other, as illustrated in FIGS. 1 and 2.

2-2. Gear Train

Figure 3:
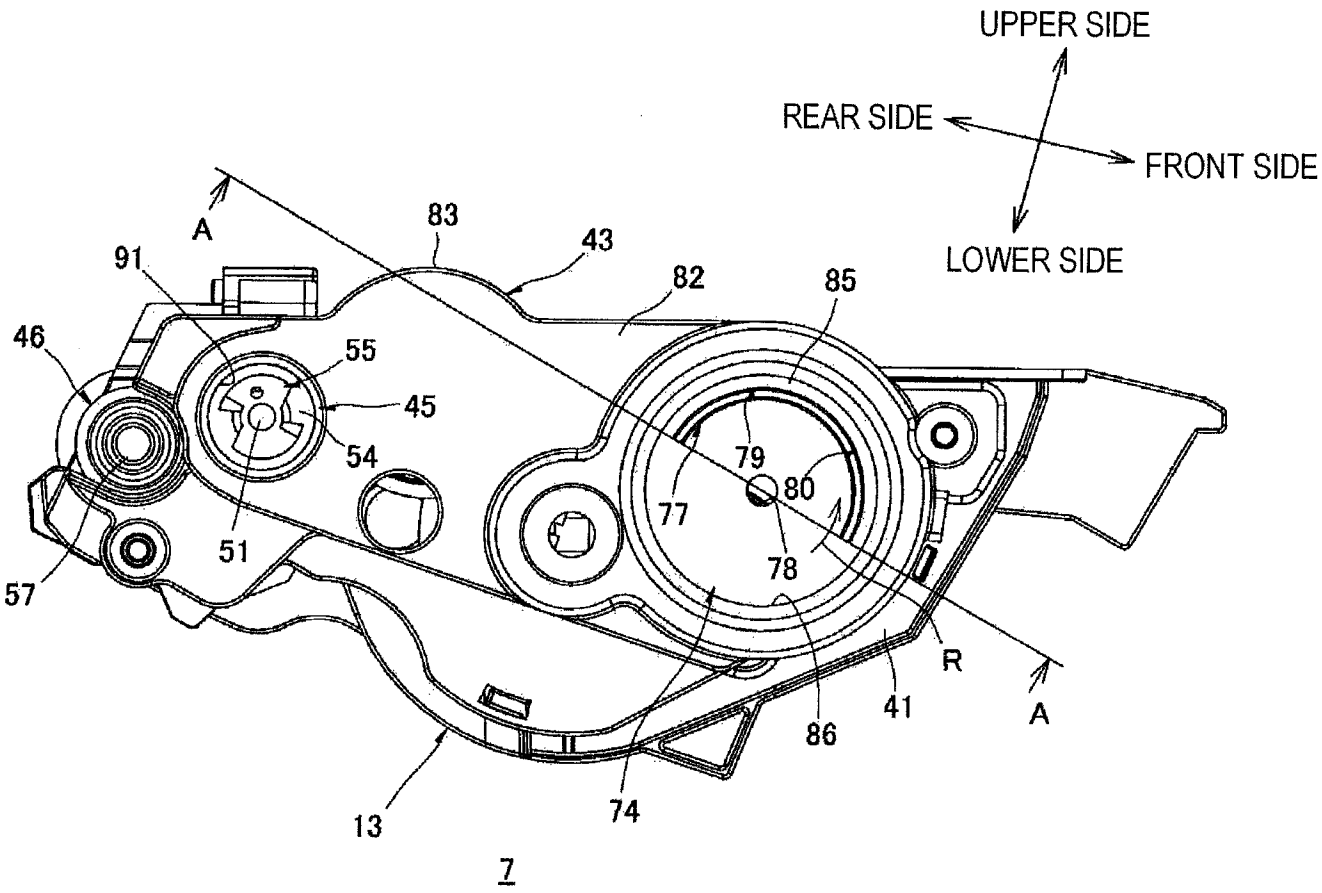
FIG. 3 is a left side sectional view of the developing cartridge.
Figure 4:
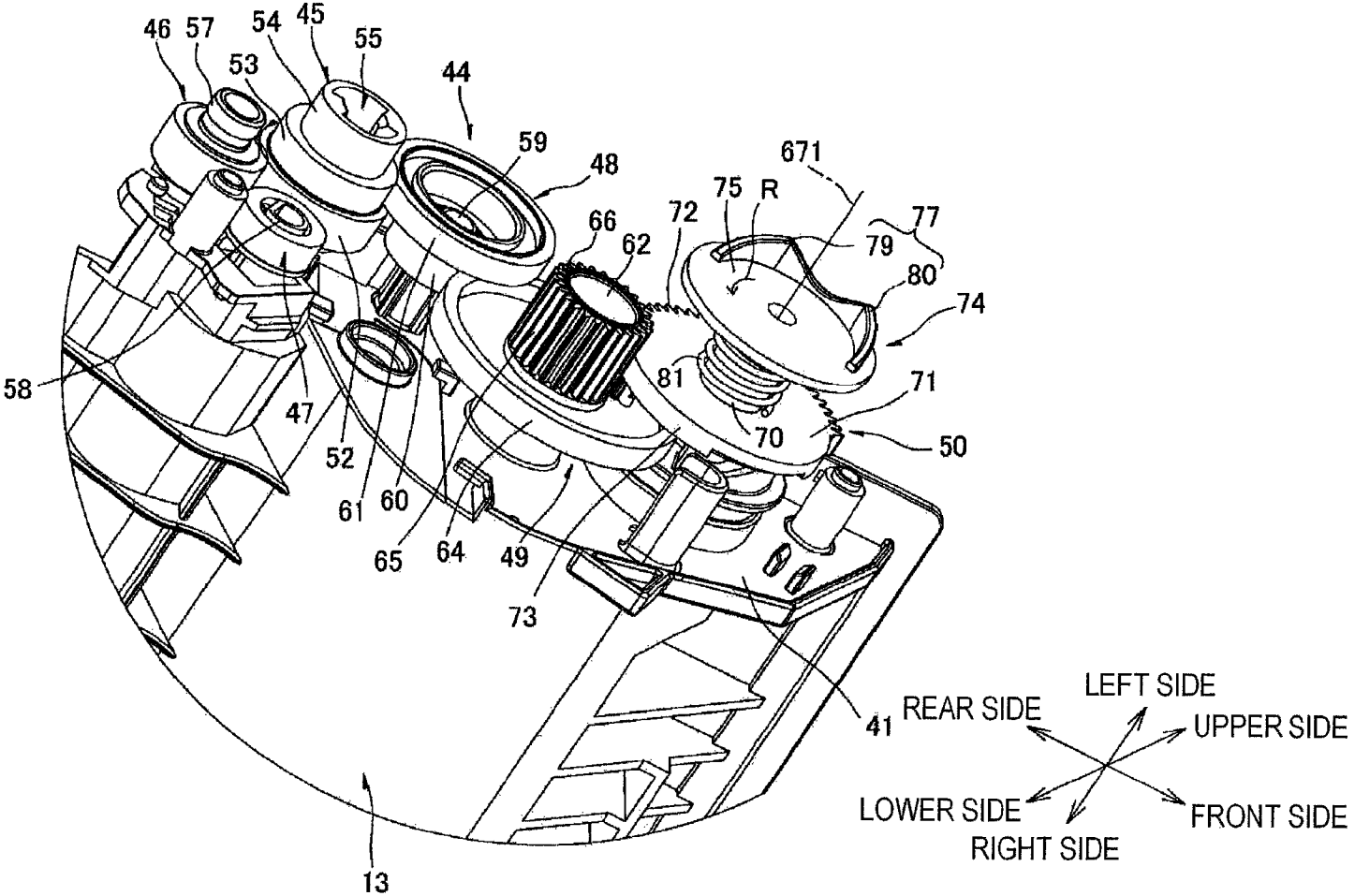
FIG. 4 is a perspective view of the developing cartridge as viewed from the lower left front side of a left end thereof, illustrating a state where a gear cover is removed from the developing cartridge.

As illustrated in FIGS. 2 and 3, a gear cover 43 as an example of a cover is attached to an outer surface (left side) of the first left side wall 41. A gear train 44 is provided inside of the gear cover 43, as illustrated in FIG. 4. The gear train 44 includes an input gear 45 as an example of a driving input member, a developing gear 46, a supply gear 47, an intermediate gear 48, an agitator gear 49 and a reset gear 50 as an example of a second rotary member.

2-2-1. Input Gear

The input gear 45 is disposed on an upper portion of the front end of the first side wall 41, as illustrated in FIG. 4. The input gear 45 is provided to rotate about an input gear rotating shaft 51 (see, FIG. 3) extending in a left-right direction. The input gear rotating shaft 51 is retained on the first side wall 41 so as not to rotate.

The input gear 45 integrally includes a large diameter gear part 52, a small diameter gear part 53 and a coupling part 54. The large diameter gear part 52, the small diameter gear part 53 and the coupling part 54 are arranged in this order from the first side wall 41.

The large diameter gear part 52 has a disc shape and a center axis thereof matches a center axis of the input gear rotating shaft 51. A plurality of gear teeth are formed on an entire peripheral surface of the large diameter gear part 52.

The small diameter gear part 53 has a disc-shape and a center axis thereof matches the center axis of the input gear rotating shaft 51 and has a diameter smaller than that of the large diameter gear part 52. A plurality of gear teeth are formed on an overall peripheral surface of the small diameter gear part 53.

The coupling part 54 has a columnar shape and a center axis thereof matches the center axis of the input gear rotating shaft 51 and a peripheral surface thereof has a diameter smaller than that of the peripheral surface of the small diameter gear part 53. Coupling recess 55 is formed on a left side of the coupling part 54. An end portion of a driving output member 56 (see, FIG. 2) which is provided in the body casing 2 is inserted into the coupling recess 55 when the developing cartridge 7 is mounted in the body casing 2.

The driving output member 56 is provided to advance and retreat in a left-right direction. The driving output member 56 advances to the right side and an end portion thereof is inserted into the coupling recess 55, in a state where the developing cartridge 7 is mounted in the body casing 2. Thereby, the driving output member 56 is coupled to the coupling recess 55 so as not to allow relative rotation therebetween. Accordingly, as the driving output member 56 rotates, the rotational force of the driving output member 56 is transmitted to the input gear 45 as a driving force and thus the input gear 45 rotates together with the driving output member 56.

2-2-2. Developing Gear

As illustrated in FIG. 4, the developing gear 46 is disposed below the rear side of the input gear 45. The developing gear 46 is attached to a developing roller shaft 57 (see, FIG. 3) of the developing roller 18 so as not to allow relative rotation therebetween. The developing roller shaft 57 is provided to rotate relative to the first side wall 41 and has a center axis which corresponds to the rotational axis 20 (see, FIG. 1) of the developing roller 18. The developing gear 46 includes gear teeth over entire peripheral surface thereof and the gear teeth are engaged with the gear teeth of the large diameter gear part 52 of the input gear 45.

2-2-3. Supply Gear

As illustrated in FIG. 4, the supply gear 47 is disposed below the input gear 45. The supply gear 47 is attached to a supply roller shaft 58 (see, FIG. 1) of the supply roller 19 so as not to allow relative rotation therebetween. The supply roller shaft 58 is provided to rotate relative to the first side wall 41 and has a center axis which corresponds to the rotational axis 21 (see, FIG. 1) of the supply roller 19. The supply gear 47 includes gear teeth over an entire peripheral surface thereof and the gear teeth are engaged with the gear teeth of the large diameter gear part 52 of the input gear 45.

2-2-4. Intermediate Gear

As illustrated in FIG. 4, the intermediate gear 48 is disposed above the front side of the input gear 45. The intermediate gear 48 is provided to rotate about a center axis of an intermediate gear rotating shaft 59 extending in a left-right direction. The intermediate gear rotating shaft 59 is non-rotatably retained on the first side wall 41.

And, the intermediate gear 48 integrally includes a small diameter part 60 and a large diameter part 61. The small diameter part 60 has a disc shape of which outer diameter is relatively small and the large diameter part 61 has a cylindrical shape of which outer diameter is relatively large. The small diameter part 60 and the large diameter part 61 are arranged in this order from the first side wall 41. Each center axis of the small diameter part 60 and the large diameter part 61 matches to the center axis of the intermediate gear rotating shaft 59.

The small diameter part 60 includes gear teeth over entire peripheral surface thereof.

The large diameter part 61 includes gear teeth over entire peripheral surface thereof. The gear teeth of the large diameter part 61 are engaged with the gear teeth of the small diameter gear part 53 of the input gear 45.

2-2-5. Agitator Gear

As illustrated in FIG. 4, the agitator gear 49 is disposed below the front side of the intermediate gear 48. The agitator gear 49 is attached to an agitator rotating shaft 62 so as not to allow relative rotation therebetween. The agitator rotating shaft 62 passes through the first side wall 41 and the second side wall 42 (see, FIG. 1) in the left-right direction and rotatably retained on the first side wall 41 and the second side wall 42. The agitator 16 is attached to the agitator rotating shaft 62 in the housing 13. Thereby, the agitator 16 and the agitator gear 49 can rotate integrally with the agitator rotating shaft 62 while using the center axis of the agitator rotating shaft 62 as the rotational axis 17 (see, FIG. 1) of the agitator.

Further, the agitator gear 49 integrally includes a large diameter gear part 64 and a small diameter gear part 65.

The large diameter gear part 64 has a disc shape of which center axis matches to the agitator rotating shaft 62. The large diameter gear part 64 includes gear teeth over entire peripheral surface thereof. The gear teeth of the large diameter gear part 64 are engaged with the gear teeth of the small diameter part 60 of the intermediate gear 48.

The small diameter gear part 65 is formed at a side opposite to the first side wall 41 relative to the large diameter gear part 64 and has a disc shape of which center axis matches to the agitator rotating shaft 62. The small diameter gear part 65 has a diameter smaller than that of the large diameter gear part 64. The small diameter gear part 65 includes gear teeth 66 over entire peripheral surface thereof.

2-2-6. Reset Gear

Figure 5:
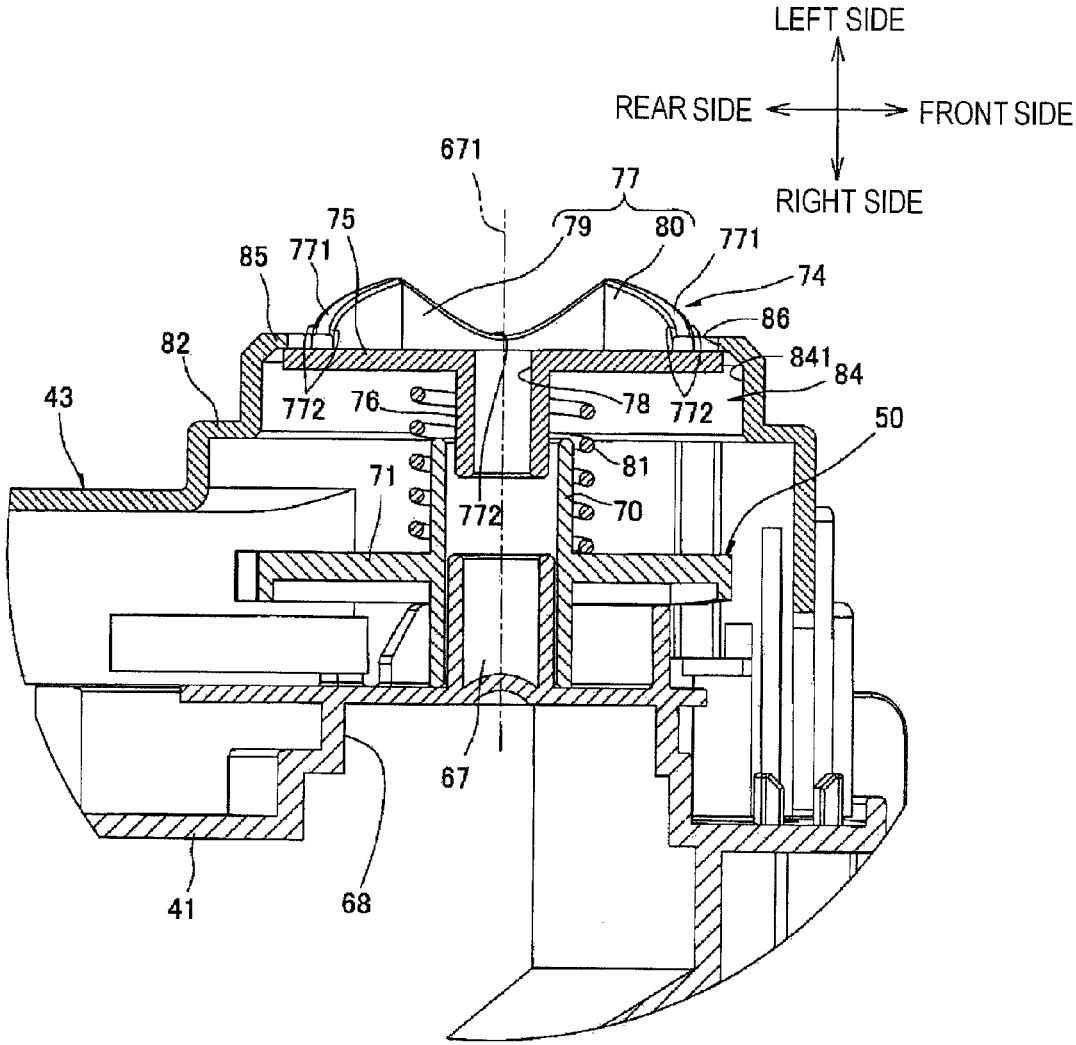
FIG. 5 is a sectional view of the developing cartridge taken along the cutting line A-A of FIG. 2.

As illustrated in FIG. 4, the reset gear 50 is disposed above the front side of the agitator gear 49. The reset gear 50 is provided to rotate about a support shaft 67 extending in a left-right direction, as illustrated in FIG. 5.

As an example of a support member, the support shaft 67 is retained on the first side wall 41 so as not to rotate.

The reset gear 50 integrally includes a right cylindrical fitting part 70 as an example of a third fitted part and a teeth missing gear part 71.

The right cylindrical fitting part 70 has a cylindrical shape of which inner diameter is substantially same as the outer diameter of the support shaft 67. The support shaft 67 is inserted into the right cylindrical fitting part 70 so as to allow relative rotation therebetween. Thereby, the reset gear 50 is rotatably supported on the support shaft 67 as a support point.

The teeth missing gear part 71 has a disc shape which protrudes from a middle portion in a direction (left-right direction) of the center axis of the right cylindrical fitting part 70. The disc shape of the missing gear part 71 protrudes in a diametric direction of the right cylindrical fitting part 70. As illustrated in FIG. 4, the teeth missing gear part 71 includes gear teeth 72 over a portion of the peripheral surface thereof. Specifically, in the peripheral surface of the teeth missing gear part 71, a part having a central angle of about 185° is provided as a teeth missing part 73 and a part other than the teeth missing part 73 having a central angle of about 175° includes the gear teeth 72. The gear teeth 72 are engaged with the gear teeth 66 of the small diameter gear part 65 of the agitator gear 49 depending upon a rotational position of the reset gear 50.

2-3. Detected Rotary Member

Figure 6:
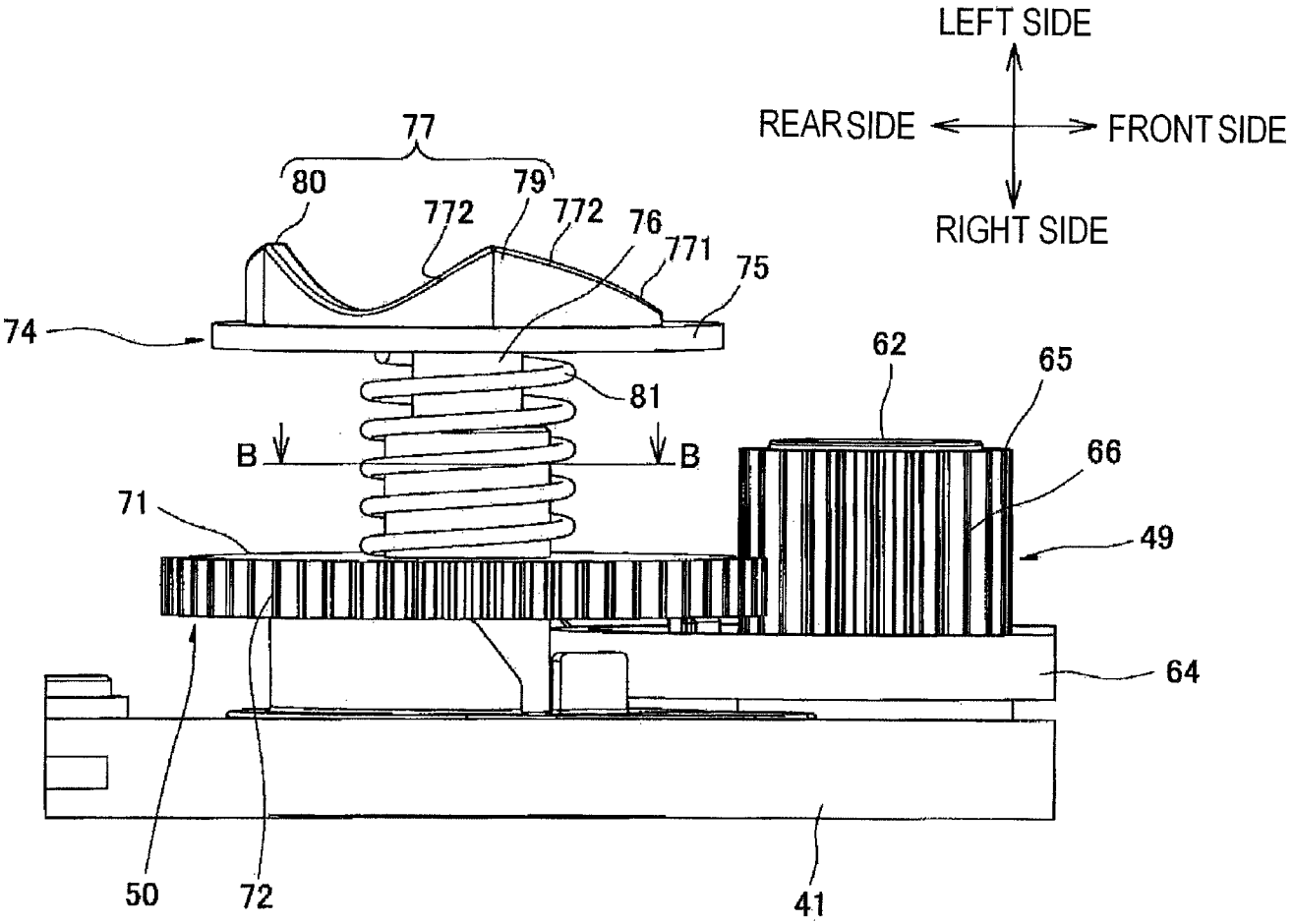
FIG. 6 is a plan view of an agitator gear, a reset gear and a detected rotary member of FIG. 4.

As illustrated in FIGS. 4, 5 and 6, a detected rotary member 74 as an example of the first rotary member is provided to a left side (outer side) of the reset gear 50.

The detected rotary member 74 integrally includes a main body 75, a left cylindrical fitting part 76 as an example of a third fitting part and a detected protrusion part 77 as an example of the protrusion.

The main body 75 has a thin disc shape. As illustrated in FIGS. 4 and 5, the main body 75 is provided at its center portion with a through hole 78 having a circular shape concentric with the main body 75.

The left cylindrical fitting part 76 has a cylindrical shape protruding to the right from the periphery of the through hole 78. The end portion of the left cylindrical fitting part 76 is loosely inserted into the end portion of the right cylindrical fitting part 70 of the reset gear 50, as illustrated in FIG. 5. That is, a right end of the left cylindrical fitting part 76 is inserted into a left end of the right cylindrical fitting part 70. Further, a space is provided at a part where the right cylindrical fitting part 70 and the left cylindrical fitting part 76 oppose in a front-rear direction. Thereby, the detected rotary member 74 is provided to allow the left end thereof to be movable in a direction along a center axis 671 of the support shaft 67 and displaceable in a direction crossing the center axis 671 as an example of the first rotational axis.

Figure 7:
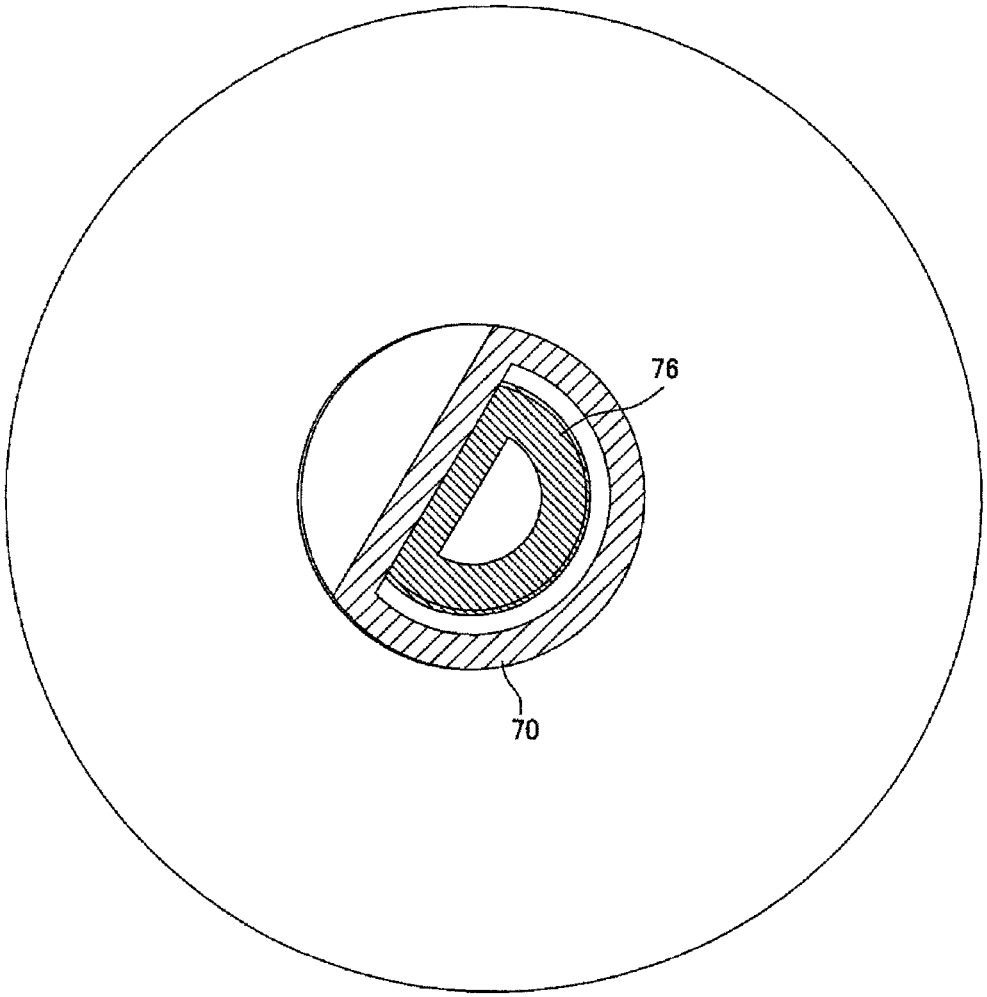
FIG. 7 is a sectional view of a right cylindrical fitting part and a left cylindrical fitting part taken along the cutting line B-B of FIG. 6.

Further, as illustrated in FIG. 7, in the opposed part of the right cylindrical fitting part 70 and the left cylindrical fitting part 76, the right cylindrical fitting part 70 and the left cylindrical fitting part 76 have a D shaped cross-section. Thereby, the right cylindrical fitting part 70 and the left cylindrical fitting part 76 have an allowance by the space therebetween and are engaged with each other so as not to allow relative rotation therebetween.

The detected protrusion part 77 protrudes to the left from a left end surface of the main body 75. As illustrated in FIG. 3, the detected protrusion part 77 includes a semicircular arc-shaped plate which is curved along the peripheral edge of the main body 75, as viewed from the left side. Further, as illustrated in FIG. 5, the detected protrusion part 77 includes a first protruding portion 79 and a second protruding portion 80 which have a substantially triangular shape, as viewed in the diametric direction of the main body 75. That is, an end 771 of the detected protrusion part 77 in a rotational direction R of the detected rotary member 74 is chamfered. Further, an end 772 (outer end and inner end) of the detected protrusion part 77 in a thickness direction (diametric direction of the main body 75) thereof is also chamfered.

2-4. Coil Spring

A coil spring 81 as an example of an elastic member is interposed in a compressed state between the reset gear 50 and the detected rotary member 74, as illustrated in FIGS. 4 to 6. The coil spring 81 surrounds the peripheries of the right cylindrical fitting part 70 and the left cylindrical fitting part 76. The coil spring includes one end contacting the teeth missing gear part 71 of the reset gear 50 and the other end contacting the main body 75 of the detected rotary member 74. The coil spring 81 causes the detected rotary member 74 to be urged in a direction away from the reset gear 50, that is, to be urged to the left.

2-5. Gear Cover

As illustrated in FIG. 2, the gear cover 43 integrally includes an opposing wall 82 opposing to the first side wall 41 from the left side and a peripheral wall 83 extending from a peripheral edge of the opposing wall 82 toward the first side wall 41. The gear cover 43 is made of resin material, for example.

The opposing wall 82 includes an opposing part 84 opposing to the reset gear 50 from the left side, as illustrated in FIG. 5. The opposing part 84 has a circular shape as viewed from the side and has a recess shape with one step on a side (left side) opposite to the first side wall 41. The detected rotary member 74 is accommodated in the opposing part 84. A peripheral wall 841 of the opposing part 84 as an example of the first fitted part is spaced apart and opposed to the detected rotary member 74 in the diametric direction of the opposing part 84.

The opposing part 84 includes a large circular opening 86 while remaining a peripheral edge 85 thereof. The peripheral edge of the main body 75 of the detected rotary member 74 contacts the peripheral edge 85 of the opposing part 84 from the inner side. Thereby, the detected protrusion part 77 of the detected rotary member 74 protrudes outward through the opening 86 while preventing the detected rotary member 74 from coming out from the opposing part 84.

Further, the opposing wall 82 includes an opening 91 for exposing the coupling part 54 of the input gear 45, as illustrated in FIG. 3.

3. Detecting New Developing Cartridge

In new developing cartridge 7, as illustrated in FIGS. 4 and 6, the gear teeth 72 in most downstream side of a rotational direction R (described later) out of the gear teeth 72 of the reset gear 50 are engaged with the gear teeth 66 of the agitator gear 49.

As the developing cartridge 7 is mounted in the body casing 2, a warm-up operation of the laser printer 1 is started. In this warm-up operation, the driving output member 56 (see, FIG. 2) is inserted into the coupling part 54 (coupling recess 55) of the input gear 45 and thus a driving force from the driving output member 56 is inputted to the input gear 45 to allow the input gear 45 to be rotated. And, as the input gear 45 rotates, the developing gear 46, the supply gear 47 and the intermediate gear 48 rotate and thus the developing roller and the supply roller 19 rotate. Further, the intermediate gear 48 rotates, the agitator gear 49 rotates and then the agitator 16 (see, FIG. 1) rotates. As the agitator 16 rotates, the toner in the developing cartridge 7 is agitated.

In new developing cartridge 7, the gear teeth 66 of the agitator gear 49 and the gear teeth 72 of the reset gear 50 are engaged with each other. Accordingly, as the agitator gear 49 rotates, the reset gear 50 is driven by the rotation of the agitator gear and rotates in the rotational direction R of a counter-clockwise direction as viewed from the left side. And, as the reset gear 50 rotates, the detected rotary member 74 rotates in the rotational direction R.

As the detected rotary member 74 rotates, the detected protrusion part 77 moves in the rotational direction R. Herein, a sensor (not illustrated) is provided in the body casing 2. For example, the configuration of the sensor is disclosed in JP-A-2006-267994. During the movement of the detected protrusion part, the first protruding portion 79 and the second protruding portion 80 of the detected protrusion part 77 subsequently passes through the detecting position of the sensor. As the first protruding portion 79 and the second protruding portion 80 reach the detecting position, the sensor outputs On signal. And, as the first protruding portion 79 and the second protruding portion 80 completely passes through the detecting position, the sensor stops outputting the On signal (Off signal is outputted).

Thereafter, as the reset gear 50 further rotates, the engagement between the gear teeth 72 of the reset gear 50 and the gear teeth 66 of the agitator gear 49 is released and the teeth missing part 73 of the reset gear 50 is opposed to the gear teeth 66. Thereby, the reset gear 50 stops rotating and thus the detected rotary member 74 stops rotating.

In this way, as a new developing cartridge 7 is firstly mounted in the body casing 2, a sensor (not illustrated) outputs the On signal twice. Accordingly, when the sensor (not illustrated) outputs the On signal twice after the developing cartridge 7 is mounted in the body casing 2, it is determined that the developing cartridge 7 is new.

Meanwhile, when an old developing cartridge 7 (herein, the old developing cartridge 7 is defined as a developing cartridge 7 which has been mounted to the body casing 2 at least once) is mounted in the body casing 2, the reset gear 50 is positioned to such that the engagement between the gear teeth 72, and the gear teeth 66 is released. Accordingly, even though the warm-up operation of the laser printer 1 is started, the reset gear 50 does not rotate. Accordingly; when the sensor (not illustrated) does not output the On signal within a predetermined period from the time point when the developing cartridge 7 is mounted in the body casing 2, it is determined that the developing cartridge 7 is old.

4. Effect 4-1. Effect 1

As mentioned above, the input gear 45 is provided to the first side wall 41 of the housing 13 of the developing cartridge 7. The input gear 45 is rotated by the rotational driving force inputted from the outside. As the input gear 45 rotates, the rotational driving force is outputted from the input gear 45.

The developing cartridge 7 includes the detected rotary member 74 which rotates in response to the rotational driving force outputted from the input gear 45. The detected rotary member 74 includes the detected protrusion part 77 protruding outward. And, the detected rotary member 74 is provided to the outer side of the first side wall 41 and is configured to be moved relative to the first side wall 41 in a direction along the center axis 671 of the support shaft 67 extending in a left-right direction and to allow an end portion (left end portion) thereof at an opposite side of the first side wall 41 to be displaced in a direction crossing the center axis 671.

Figure 8:
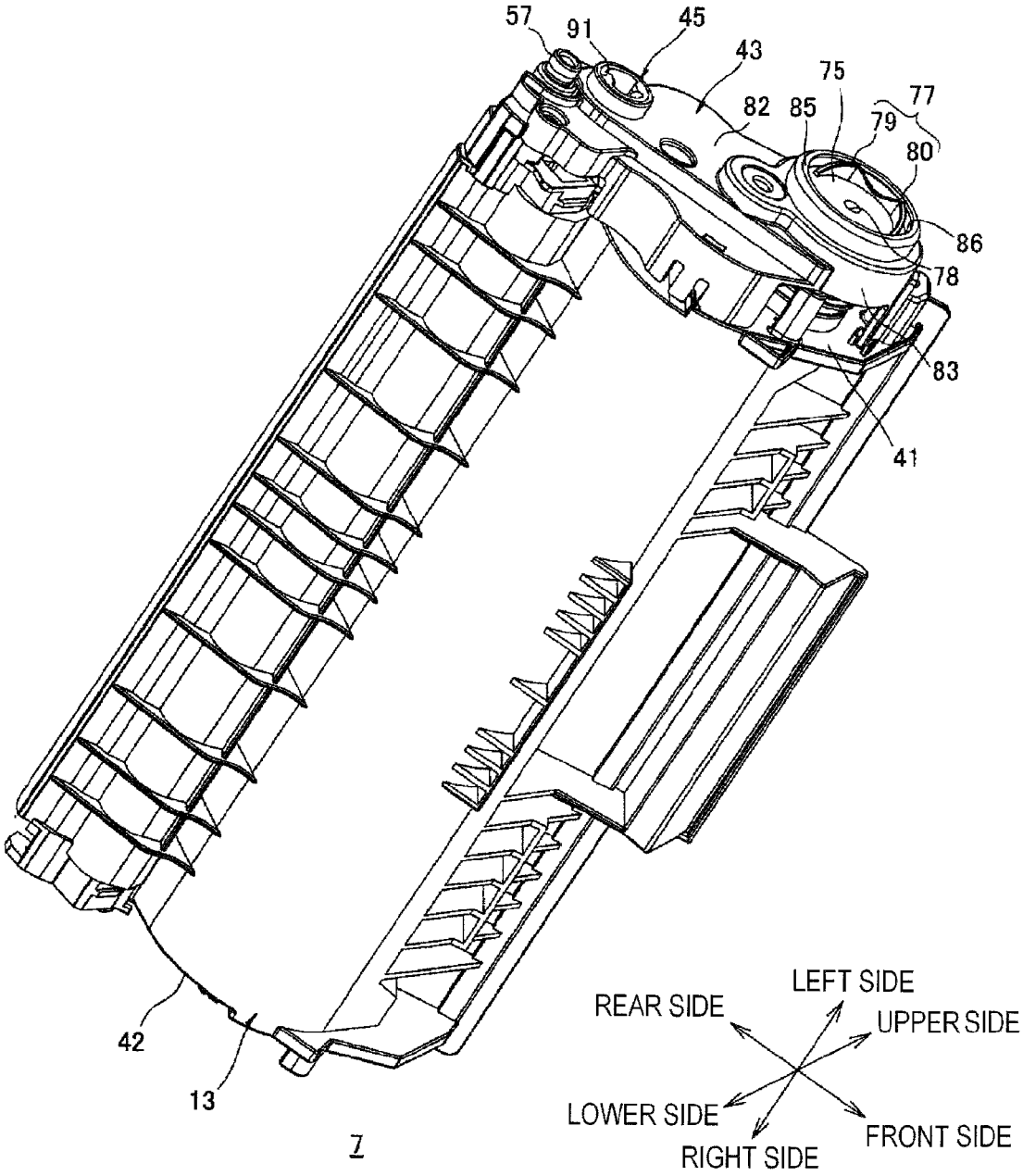
FIG. 8 is a perspective view of the developing cartridge as viewed from the lower left side thereof, illustrating a state where the detected rotary member is immersed therein.
Figure 9A:
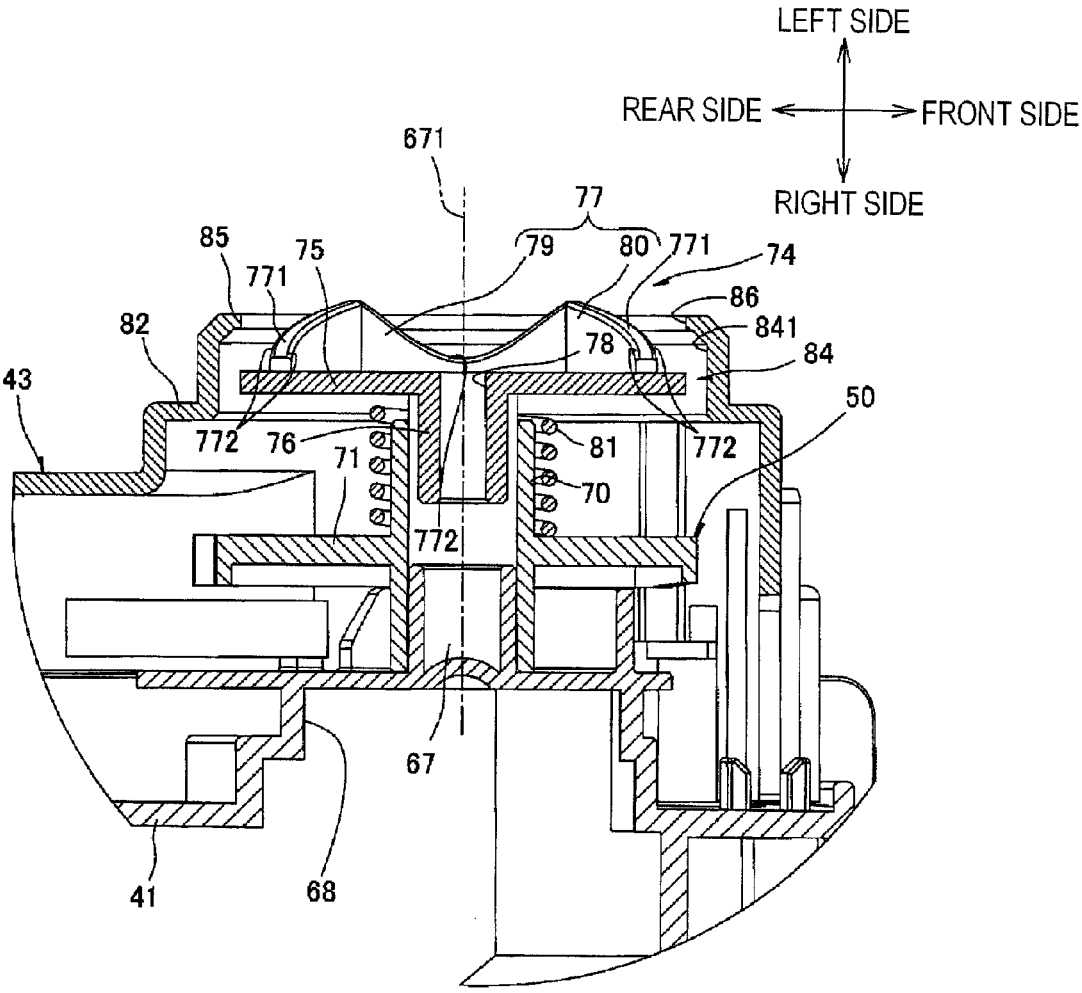
FIG. 9A is a sectional view of the developing cartridge illustrated in FIG. 8.
Figure 9B:
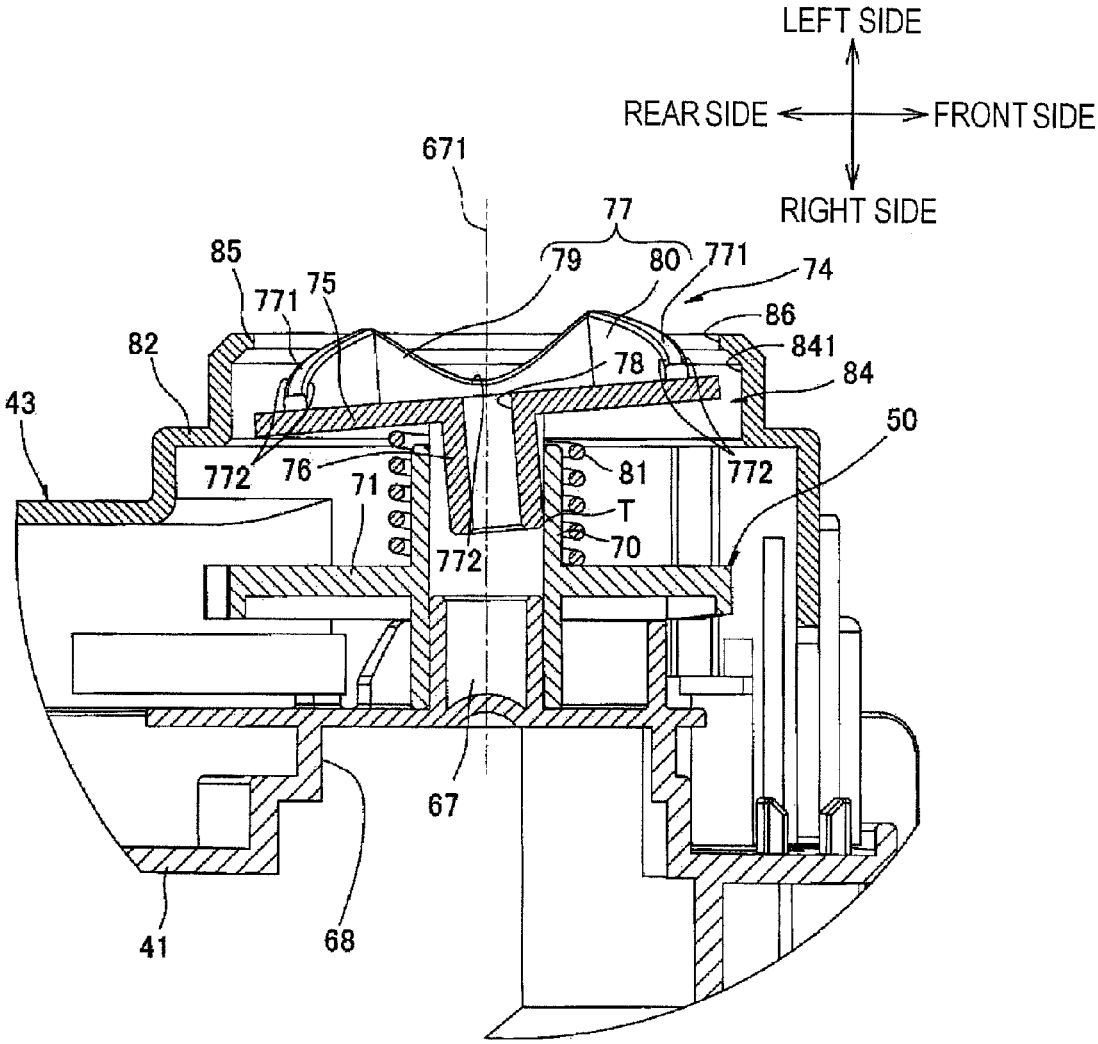
FIG. 9B is a sectional view of the developing cartridge illustrated in FIG. 8, illustrating a state where the detected rotary member is displaced.

Therefore, when other components contact the detected protrusion part 77 to apply a force on the detected protrusion part 77 during the transportation of the developing cartridge 7, as illustrated in FIGS. 8, 9A and 9B, the detected rotary member 74 is displaced in a direction along the center axis 671 and/or a direction crossing the center axis 671. Accordingly, it is possible to prevent a strong force from being applied to the detected protrusion part 77 and to reduce the wear of the detected protrusion part 77. Further, the force applied to the detected protrusion part 77 can be relieved and thus the damage of the detected protrusion part 77 can be avoided.

4-2. Effect 2

The gear cover 43 is attached to the first side wall 41. The gear cover 43 includes the opposing part 84 which is opposed to the detected rotary member 74 from the opposite side (outer side) of the first side wall 41. Accordingly, it is possible to prevent the detected rotary member 74 from coming out outwardly.

4-3. Effect 3

The detected rotary member 74 includes the left cylindrical fitting part 76 extending in a direction along the center axis 671. Meanwhile, the gear cover 43 includes the peripheral wall 841 which is spaced apart and opposed to the left cylindrical fitting part 76 in a direction perpendicular to the direction along the center axis 671. Thereby, it is possible to prevent the detected rotary member 74 from coming out and to allow the detected rotary member 74 to be displaced in a direction crossing the center axis 671.

4-4. Effect 4

The reset gear 50 is provided to the first side wall 41 and is configured to rotate about the center axis 671. The detected rotary member 74 is provided to the opposite side of the first side wall 41 relative to the reset gear 50. The rotational driving force is outputted from the input gear 45 and transmitted to the detected rotary member 74 by the reset gear 50.

The reset gear 50 includes the right cylindrical fitting part 70 which is spaced apart and opposed to the left cylindrical fitting part 76 in a direction perpendicular to the direction along the center axis 671. Thereby; it is possible to allow the detected rotary member 74 to be displaced in a direction crossing the center axis 671.

4-5. Effect 5

As the detected rotary member 74 is displaced in a direction crossing the center axis 671, the left cylindrical fitting part 76 and the right cylindrical fitting part 70 contacts with each other at one point. Specifically, the end portion (left end) of the right cylindrical fitting part 70 and the end portion (right end) of the left cylindrical fitting part 76 contacts with each other at one point. In this case, the end portion (left end) of the right cylindrical fitting part 70 is considered as an example of a first position and the end portion (right end) of the left cylindrical fitting part 76 is considered as an example of a second position. More specifically, for example, an approximately center portion of the inner surface of the right cylindrical fitting part 70 in a left-right direction and the end portion (right end) of the left cylindrical fitting part 76 contacts with each other at one point (contact point T, see FIG. 9B). In this case, the approximately center portion of the right cylindrical fitting part 70 is considered as an example of the first position and the end portion (right end) of the left cylindrical fitting part 76 is considered as an example of the second position. Thereby, it is possible to allow the detected rotary member 74 to be displaced in a direction crossing the center axis 671.

4-6. Effect 6

The coil spring 81 causes the detected rotary member 74 to be urged in a direction away from the first side wall 41, that is, in a direction where the detected protrusion part 77 protrudes outwardly. When other components contact the detected protrusion part 77 to apply a force to the detected protrusion part 77, the detected rotary member 74 is displaced in a direction along the center axis 671 against the urging force (elastic force) of the coil spring 81. Accordingly, only when other components contact the detected protrusion part 77, the detected rotary member 74 can be displaced in a direction where the detected protrusion part 77 is immersed inwardly.

4-7. Effect 7

The detected protrusion part 77 includes the first protruding portion 79 and the second protruding portion 80 which have a substantially triangular plate shape and are provided continuously in the rotational direction R. Thereby, the end 771 of the detected protrusion part 77 in the rotational direction R of the detected rotary member 74 is chamfered.

Further, both ends 772 of the detected protrusion part 77 in the thickness direction R thereof are also chamfered. Herein, the thickness direction refers to a diametric direction of the main body 75, that is, a diametric direction relative to the rotational direction R.

Therefore, it is possible to effectively prevent the detected protrusion part 77 from being engaged with other components in the rotational direction R and the diametric direction thereof during the transportation of the developing cartridge 7.

Second Exemplary Embodiment

1. Configuration

Figure 10:
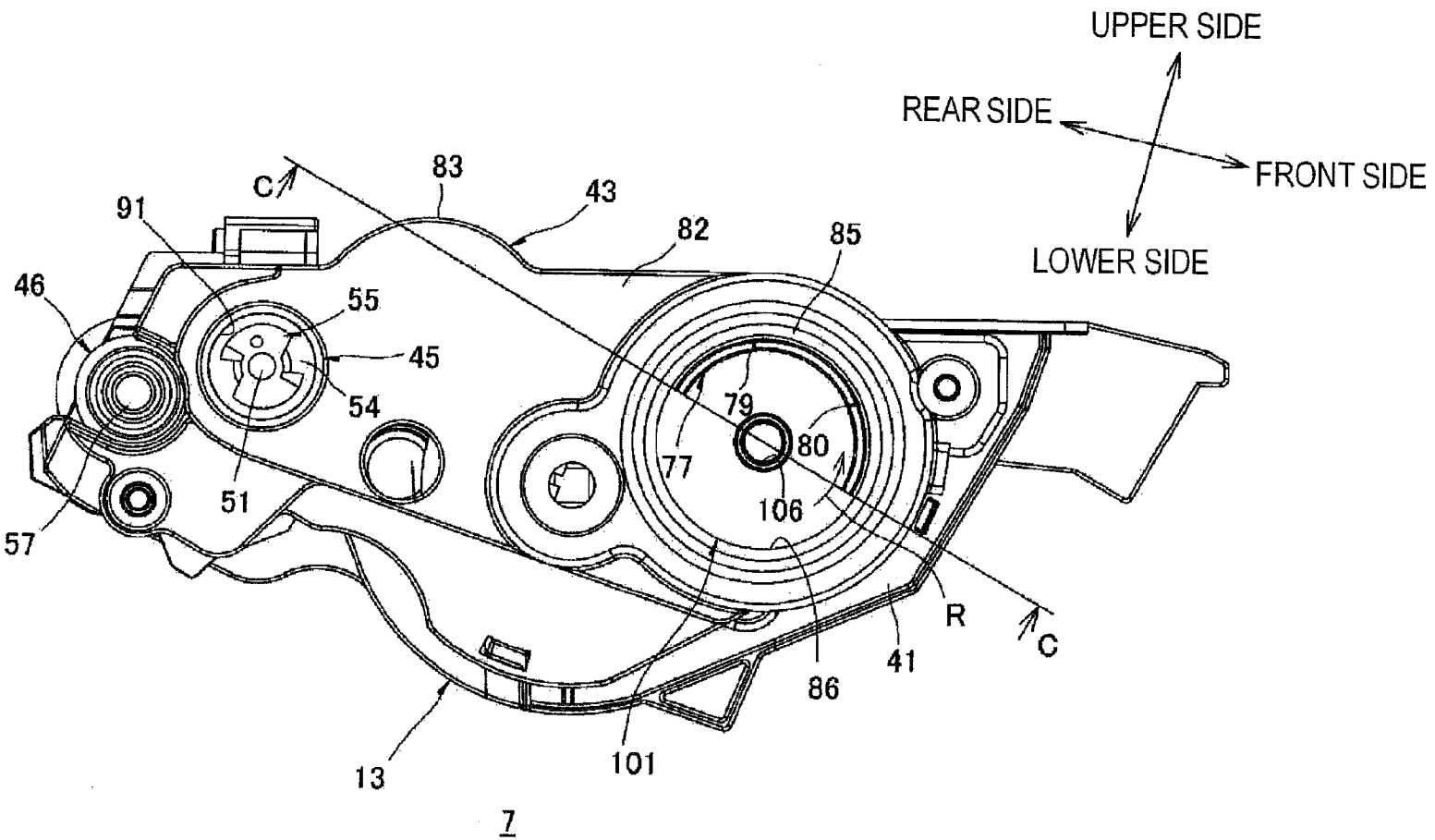
FIG. 10 is a left side sectional view of a developing cartridge according to a second exemplary embodiment of the present invention.
Figure 11:
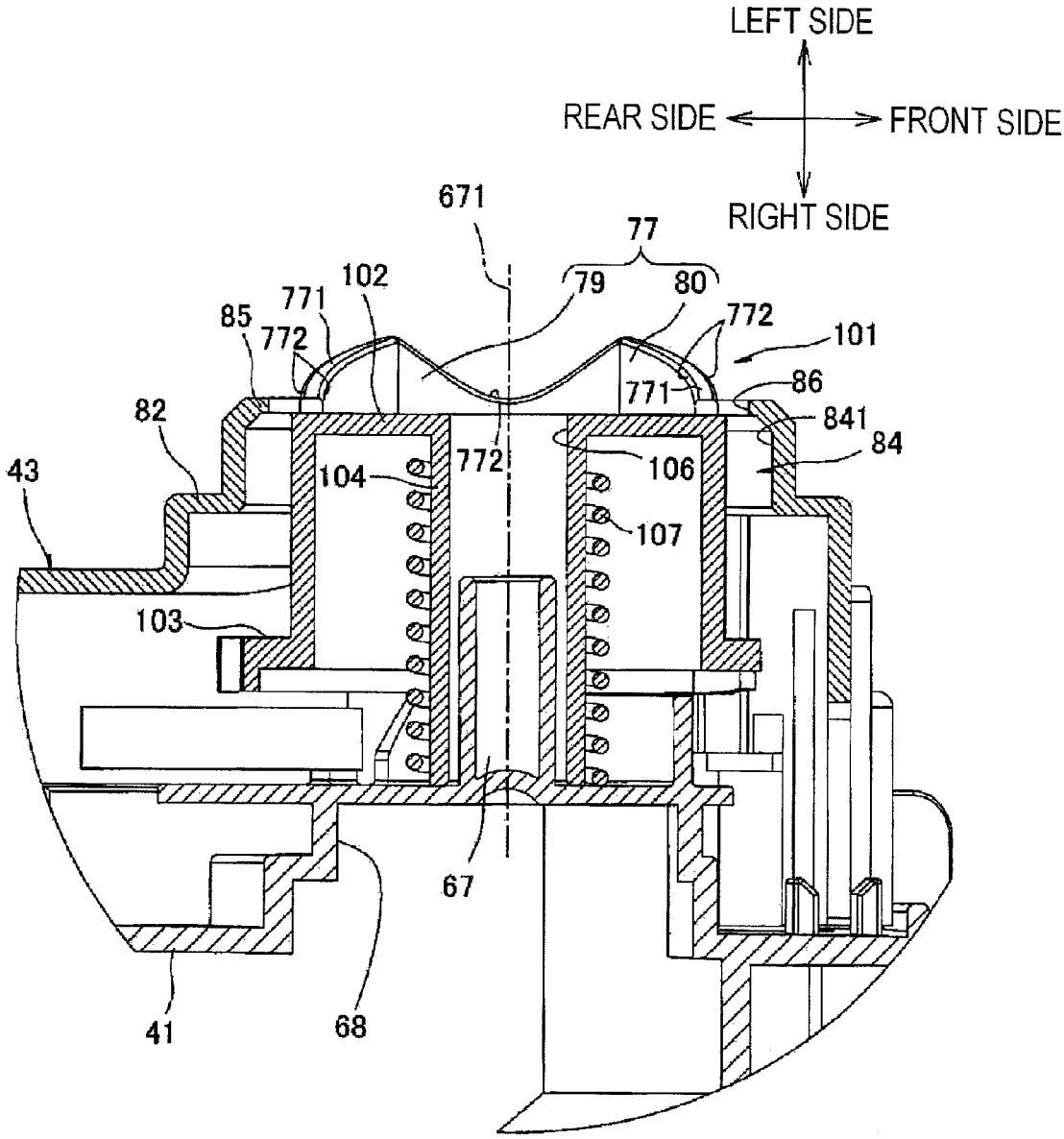
FIG. 11 is a sectional view of the developing cartridge taken along the cutting line C-C of FIG. 10.
Figure 12:
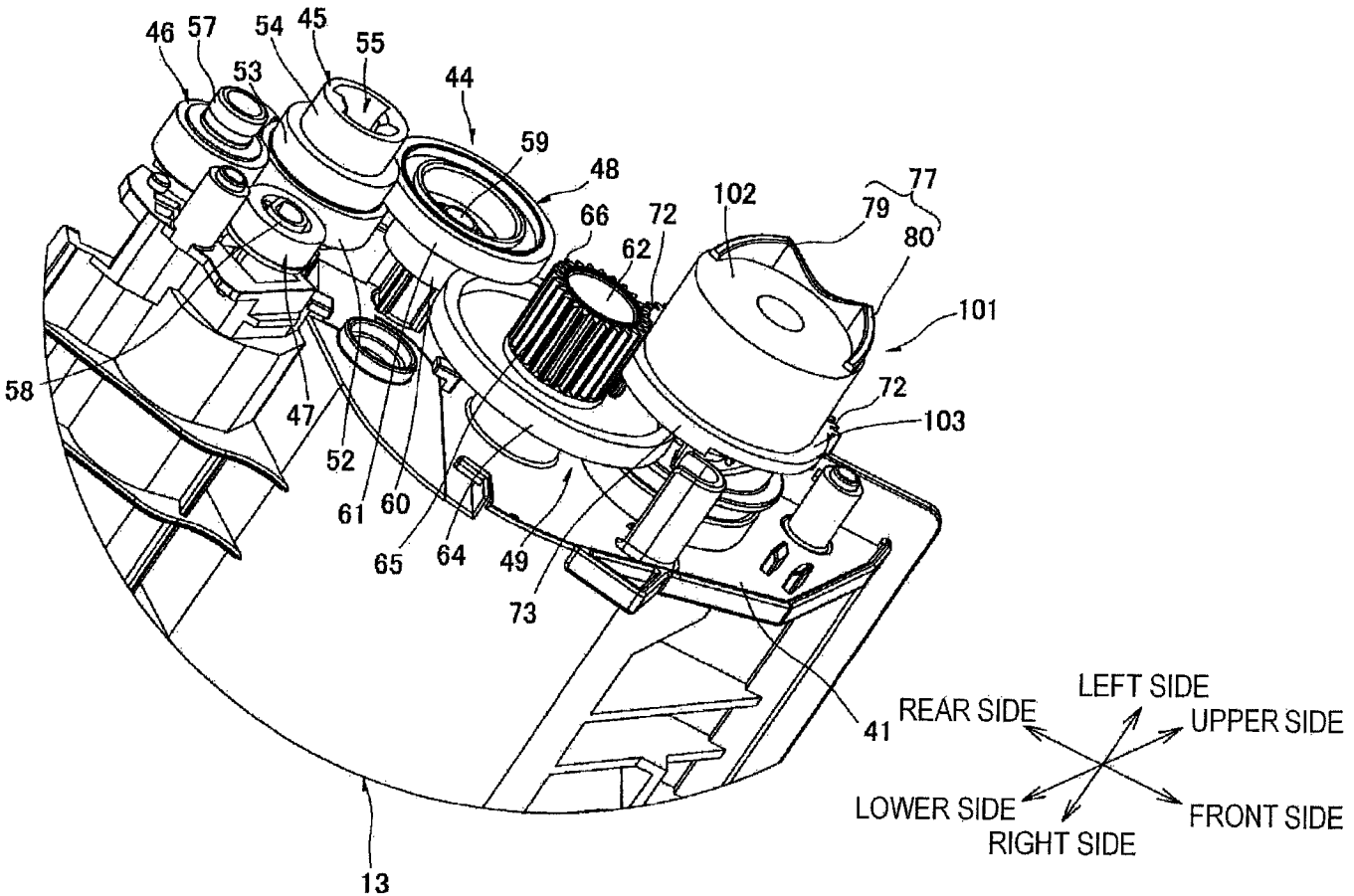
FIG. 12 is a perspective view of the developing cartridge of FIG. 10 as viewed from the lower left front side of a left end thereof, illustrating a state where a gear cover is removed from the developing cartridge.

Instead of the configurations illustrated in FIGS. 3 to 9B, configurations illustrated in FIGS. 10, 11 and 12 may be employed. In FIGS. 10 to 12, the same or similar element will be denoted by the same reference numeral as that of the first exemplary embodiment.

In the configurations illustrated in FIGS. 10 to 12, instead of the reset gear 50 and the detected rotary member 74 illustrated in FIG. 5, a detected gear 101 having functions of both the reset gear and the detected rotary member is provided.

As illustrated in FIGS. 11 and 12, the detected gear 101 as an example of the first rotary member integrally includes a main body 120, a teeth missing gear part 103, a cylindrical fitting part 104 as an example of a second fitting part and the detected protrusion part 77.

The main body 102 has a cylindrical shape with a closed left end surface. The main body 102 is provided at its center portion with a through hole 106 having a circular shape concentric with the main body 102.

The teeth missing gear part 103 has a flange shape which protrudes from a right end of the main body 102 to the periphery. As illustrated in FIG. 12, the teeth missing gear part 103 includes gear teeth 72 partially on the peripheral surface thereof. Specifically, in the peripheral surface of the teeth missing gear part 103, a part having a central angle of about 185° is provided as a teeth missing part 73 and a part other than the teeth missing part 73 having a central angle of about 175° includes the gear teeth 72. The gear teeth 72 are engaged with the gear teeth 66 of the small diameter gear part 65 of the agitator gear 49 depending upon a rotational position of the reset gear 50.

The cylindrical fitting part 104 has a cylindrical shape protruding to the right direction (direction along the center axis 671 of the support shaft 67) from the periphery of the through hole 106. As illustrated in FIG. 11, the support shaft 67 is inserted into the cylindrical fitting part 104 so as to allow relative rotation therebetween. Herein, the support shaft 67 is an example of the support member and the second fitted part. The cylindrical fitting part 104 has an inner diameter larger than an outer diameter of the support shaft 67. Accordingly, a space is provided in the opposed part of an outer peripheral surface of the support shaft 67 and an inner peripheral surface of the cylindrical fitting part 104. Thereby, the detected gear 101 is rotatably supported on the support shaft 67. Also, the detected gear 101 is provided to allow the left end thereof to be movable in a direction along a center axis 671 of the support shaft 67 and displaceable in a direction crossing the center axis 671.

A coil spring 107 as an example of an elastic member is interposed in a compressed state between the first side wall 41 and the detected gear 101. The coil spring 107 surrounds the peripheries of the support shaft 67 and the cylindrical fitting part 104. The coil spring includes one end contacting the first side wall 41 and the other end contacting the main body 102 of the detected gear 101. The coil spring 107 causes the detected gear 101 to be urged in a direction away from the first side wall 41, that is, to be urged to the left.

2. Effect

2-1. Effect 1

The support shaft 67 for rotatably supporting the detected gear 101 is provided to the first side wall 41. The detected gear 101 includes the cylindrical fitting part 104 extending in a direction along the center axis 671 of the support shaft 67. The support shaft is spaced apart and opposed to the cylindrical fitting part 104 in a direction perpendicular to the direction along the center axis 671. Thereby, the detected gear 101 can be displaced in the direction crossing the center axis 671 while being rotatably supported by the support shaft 67.

Therefore, when other components contact the detected protrusion part 77 to apply a force to the detected protrusion part 77 during the transportation of the developing cartridge 7, the detected gear 101 is displaced in a direction along the center axis 671 and/or a direction crossing the center axis 671. Accordingly, it is possible to prevent a strong force from being applied to the detected protrusion part 77 and to reduce the wear to the detected protrusion part 77. Further, the force applied on the detected protrusion part 77 can be relieved and thus the damage of the detected protrusion part 77 can be alleviated.

2-2. Effect 2

As the detected gear 101 is displaced in a direction crossing the center axis 671, the support shaft 67 and the cylindrical fitting part 104 contacts with each other at one point. Specifically, the end portion (left end) of the support shaft 67 and the end portion (right end) of the cylindrical fitting part 104 contacts with each other at one point. In this case, the end portion (left end) of the support shaft 67 is considered as an example of a first position and the end portion (right end) of the cylindrical fitting part 104 is considered as an example of a second position. Thereby, it is possible to allow the detected gear 101 to be displaced in a direction crossing the center axis 671.

Third Exemplary Embodiment

Figure 13:
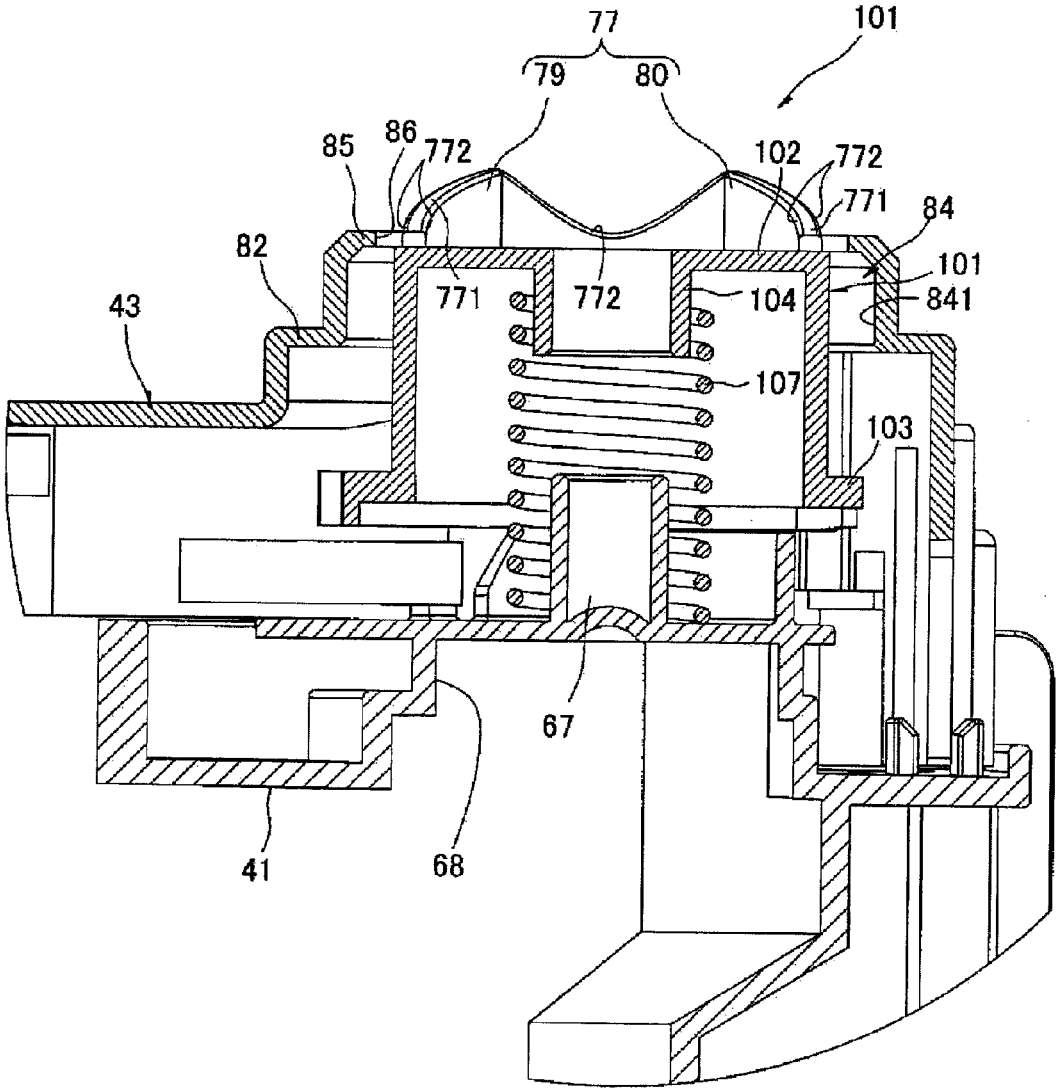
FIG. 13 is a sectional view of a developing cartridge according to a third exemplary embodiment of the present invention.

Instead of the configurations illustrated in FIG. 11, configurations illustrated in FIG. 13 may be employed. In FIG. 13, the same or similar element will be denoted by the same reference numeral as that of the second exemplary embodiment.

In the configurations illustrated in FIG. 13, the length of the cylindrical fitting part 104 is short, as compared to the configurations illustrated in FIG. 11 and the support shaft 67 is not inserted into the cylindrical fitting part 104.

Similarly, in the configuration illustrated in FIG. 13, the detected gear 101 is provided to allow the left end thereof to be movable in a direction along a center axis 671 of the support shaft 67 and displaceable in a direction crossing the center axis 671.

Therefore, when other components contact the detected protrusion part 77 to apply a force on the detected protrusion part 77 during the transportation of the developing cartridge 7, the detected gear 101 is displaced in a direction along the center axis 671 and/or a direction crossing the center axis 671. Accordingly, it is possible to prevent a strong force from being applied to the detected protrusion part 77 and to reduce the wear on the detected protrusion part 77. Further, the force applied on the detected protrusion part 77 can be relieved and thus the damage of the detected protrusion part 77 can be alleviated.

<Modification>

Hereinabove, the exemplary embodiments of the present invention has been described, but the present invention is not limited thereto and may be practiced in modified embodiments.

1. Modification 1

In the configuration according to the first embodiment, the left cylindrical fitting part 76 of the detected rotary member 74 is loosely inserted into the end portion of the right cylindrical fitting part 70 of the reset gear 50, as illustrated in FIGS. 5 and 9.

Figure 14:
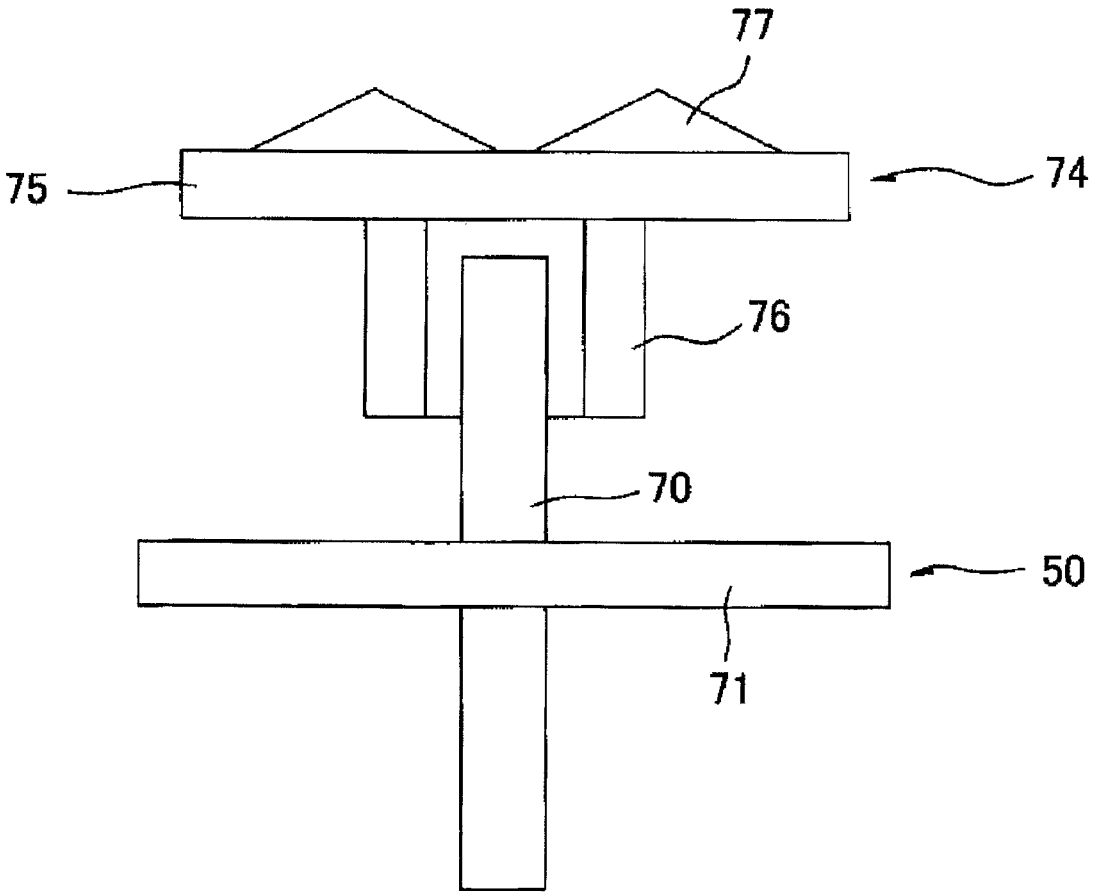
FIG. 14 is a schematic sectional view of a reset gear and a detected rotary member according to a modification 1.

Instead of the above configuration, a configuration may be employed in which the left cylindrical fitting part 76 of the detected rotary member 74 has an inner diameter larger than an outer diameter of the right cylindrical fitting part 70 of the reset gear 50 and an end portion of the right cylindrical fitting part 70 is inserted into the left cylindrical fitting part 76, as illustrated in FIG. 14.

2. Modification 2

Figure 15:
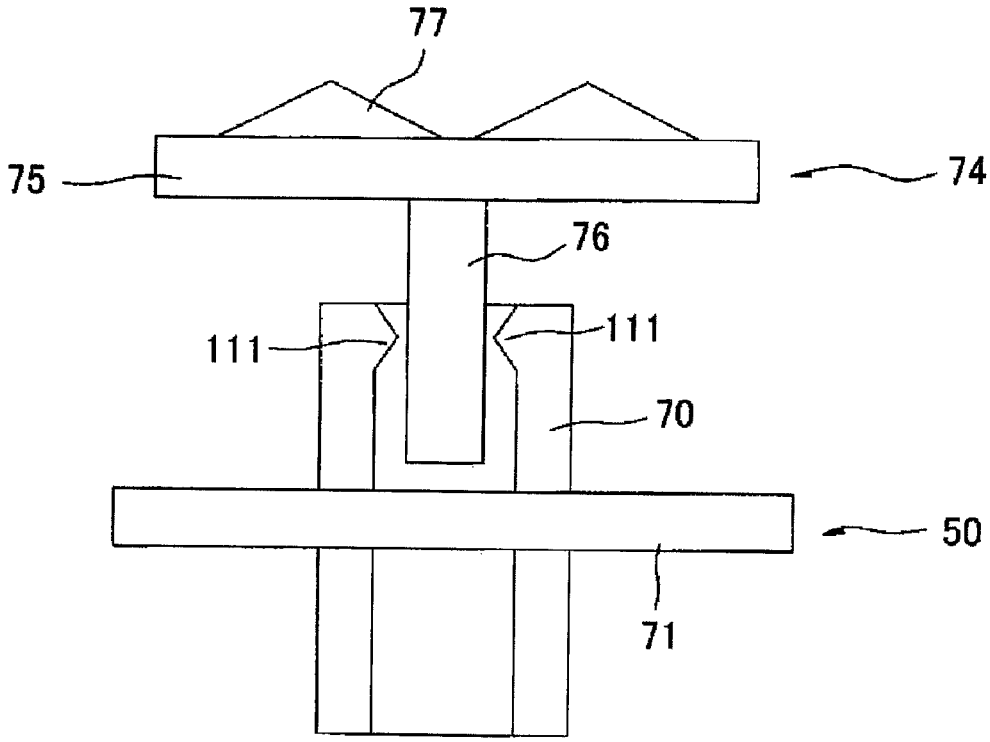
FIG. 15 is a schematic sectional view of a reset gear and a detected rotary member according to a modification 2.

As illustrated in FIG. 15, a configuration may be employed in which two protrusions 111 are formed on the end portion of the right cylindrical fitting part 70 of the reset gear 50 and the detected rotary member 74 is supported on the right cylindrical fitting part 70 in such a way that these protrusions 111 are opposed to the left cylindrical fitting part 76 of the detected rotary member 74 to have a slight allowance therebetween 3. Modification 3

Figure 16:
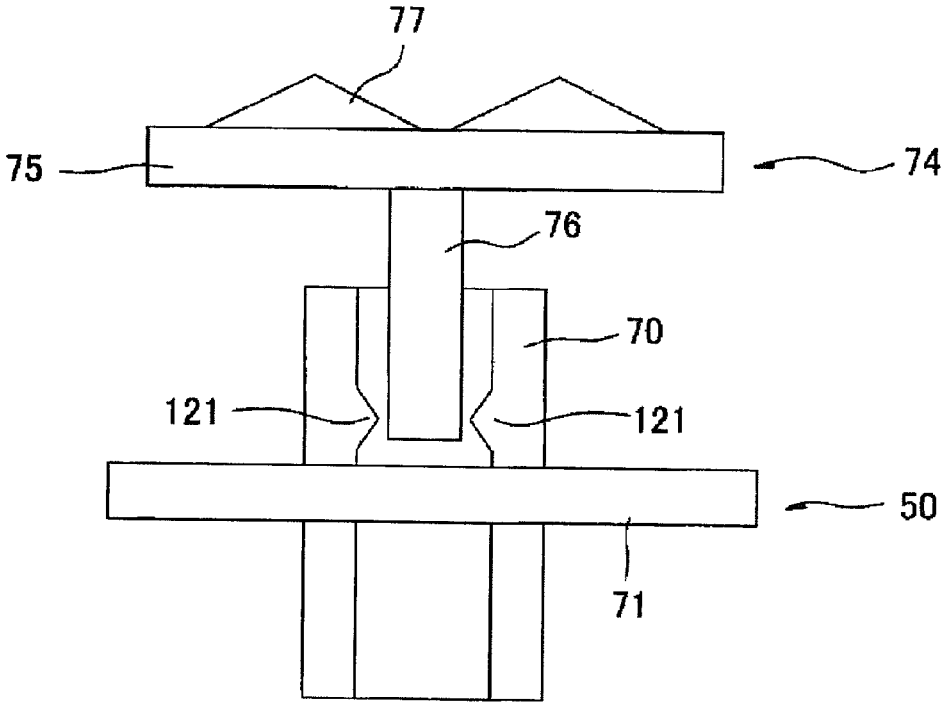
FIG. 16 is a schematic sectional view of a reset gear and a detected rotary member according to a modification 3.

As illustrated in FIG. 16, a configuration may be employed in which two protrusions 111 are formed on the right cylindrical fitting part 70 of the reset gear 50 and the detected rotary member 74 is supported on the right cylindrical fitting part 70 in such a way that these protrusions 111 are opposed to the end portion of the left cylindrical fitting part 76 of the detected rotary member 74 to have a slight allowance therebetween, 4. Modifications 4 to 8

In the configuration according to the first embodiment, the opposed part of the right cylindrical fitting part 70 and the left cylindrical fitting part 76 has a D shaped cross-section, as illustrated in FIG. 7.

The cross-sectional shape of the opposed part of the right cylindrical fitting part 70 and the left cylindrical fitting part 76 is not limited to the D shape and any cross-sectional shape may be employed as long as the right cylindrical fitting part 70 and the left cylindrical fitting part 76 are engaged with each other so as not to allow relative rotation therebetween.

Figure 17:
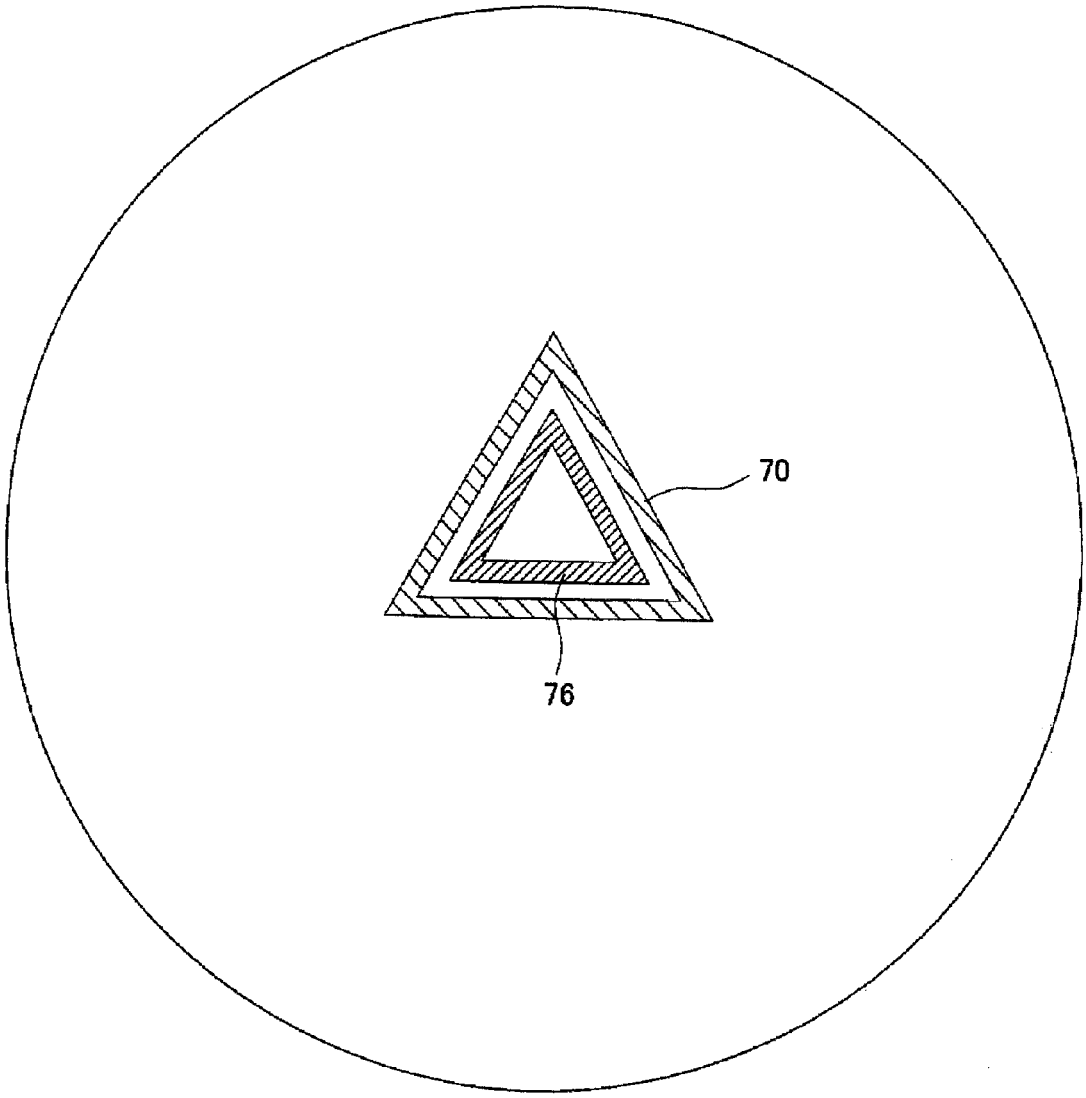
FIG. 17 is a sectional view of a right cylindrical fitting part and a left cylindrical fitting part according to a modification 4.
Figure 18:
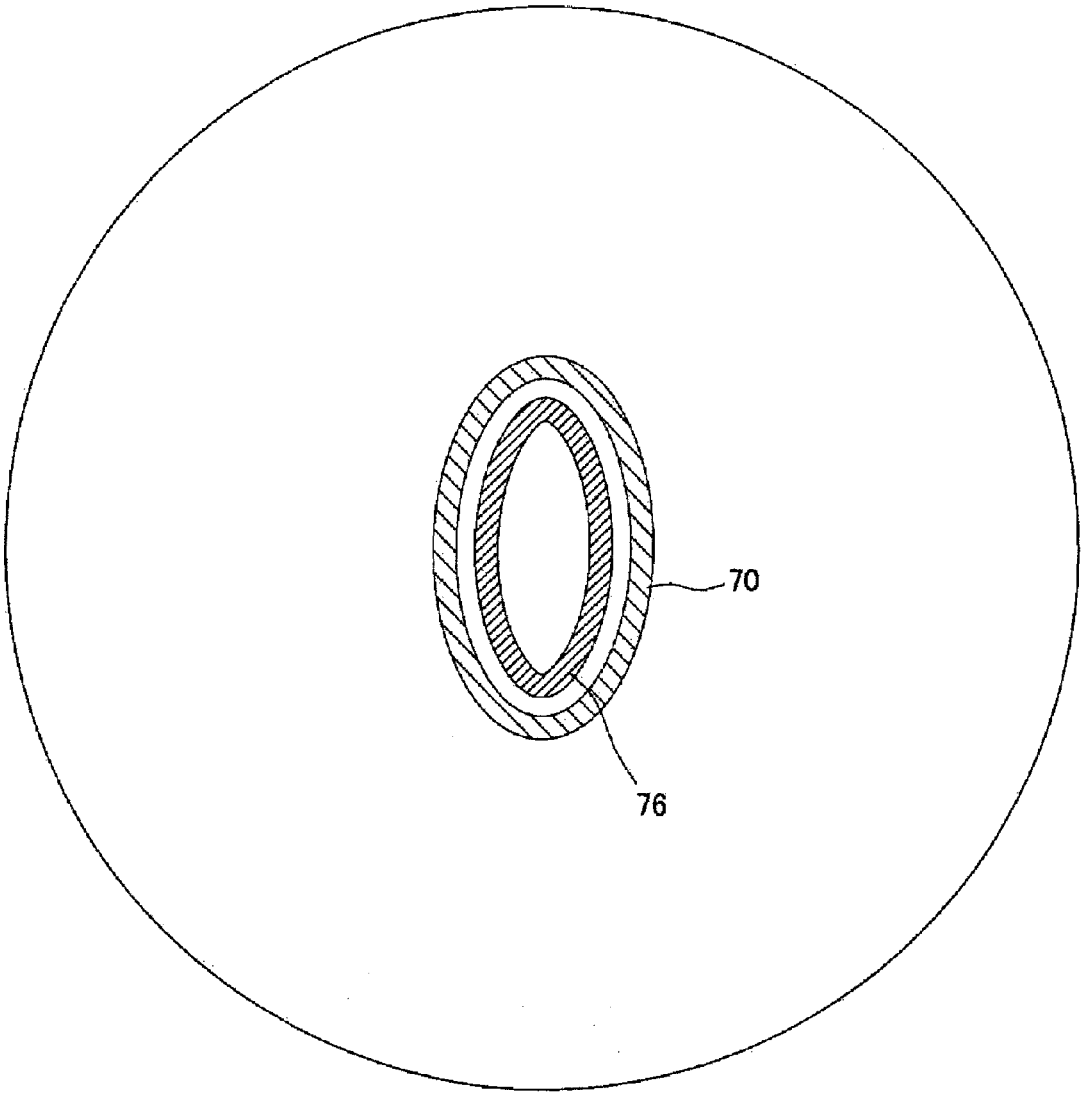
FIG. 18 is a sectional view of a right cylindrical fitting part and a left cylindrical fitting part according to a modification 5.

For example, the cross-sectional shape of the opposed part of the right cylindrical fitting part 70 and the left cylindrical fitting part 76 may be a triangular shape as illustrated in FIG. 17 (modification 4) or an elliptical shape as illustrated in FIG. 18 (modification 5).

Figure 19:
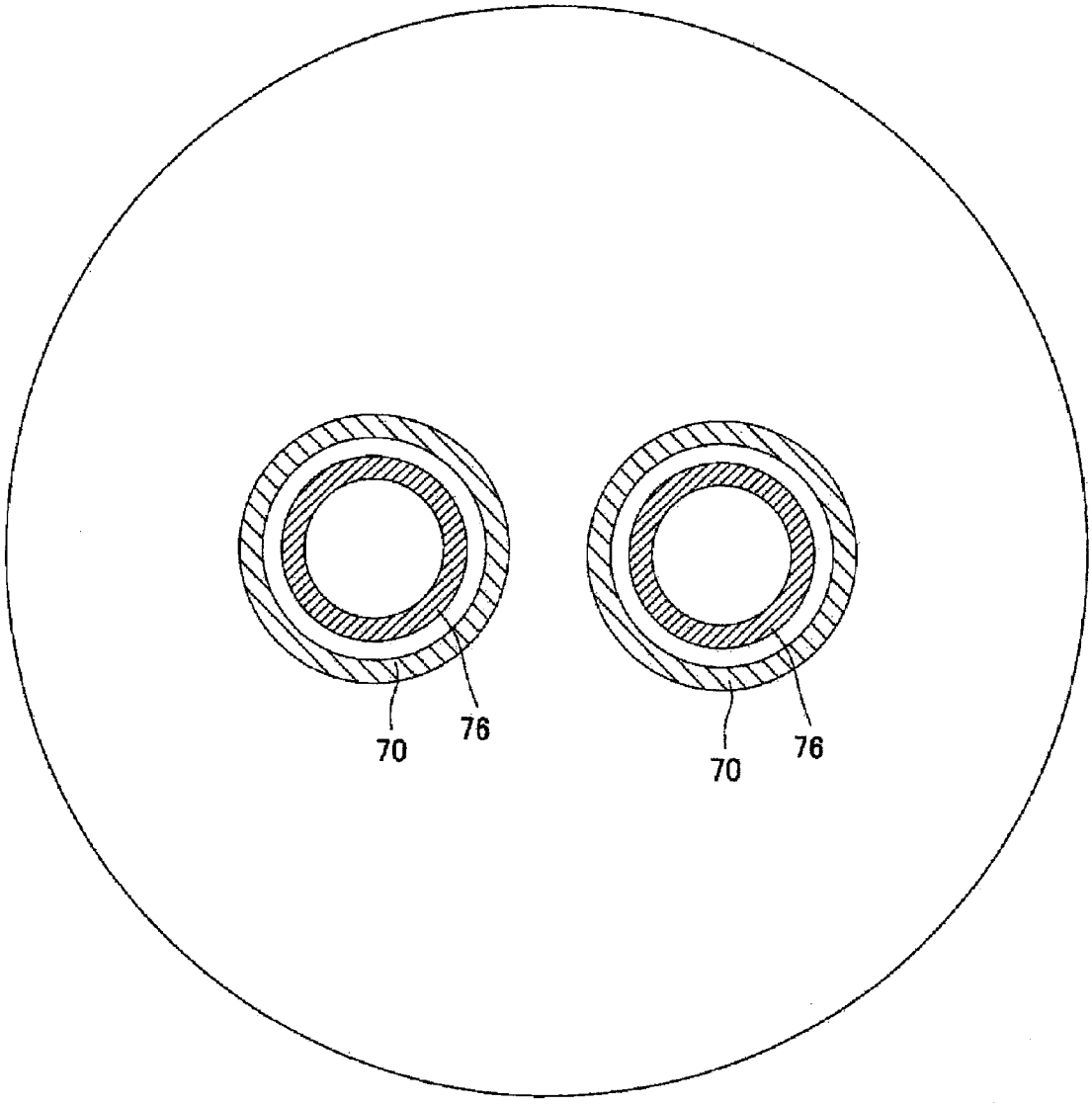
FIG. 19 is a sectional view of a right cylindrical fitting part and a left cylindrical fitting part according to a modification 6.

Further, as illustrated in FIG. 19, a configuration may be employed in which two sets of the right cylindrical fitting part 70 and the left cylindrical fitting part 76 are provided and the cross-sectional shape of the opposed part of the right cylindrical fitting part 70 and the left cylindrical fitting part 76 is a circular shape (modification 6).

Figure 20:
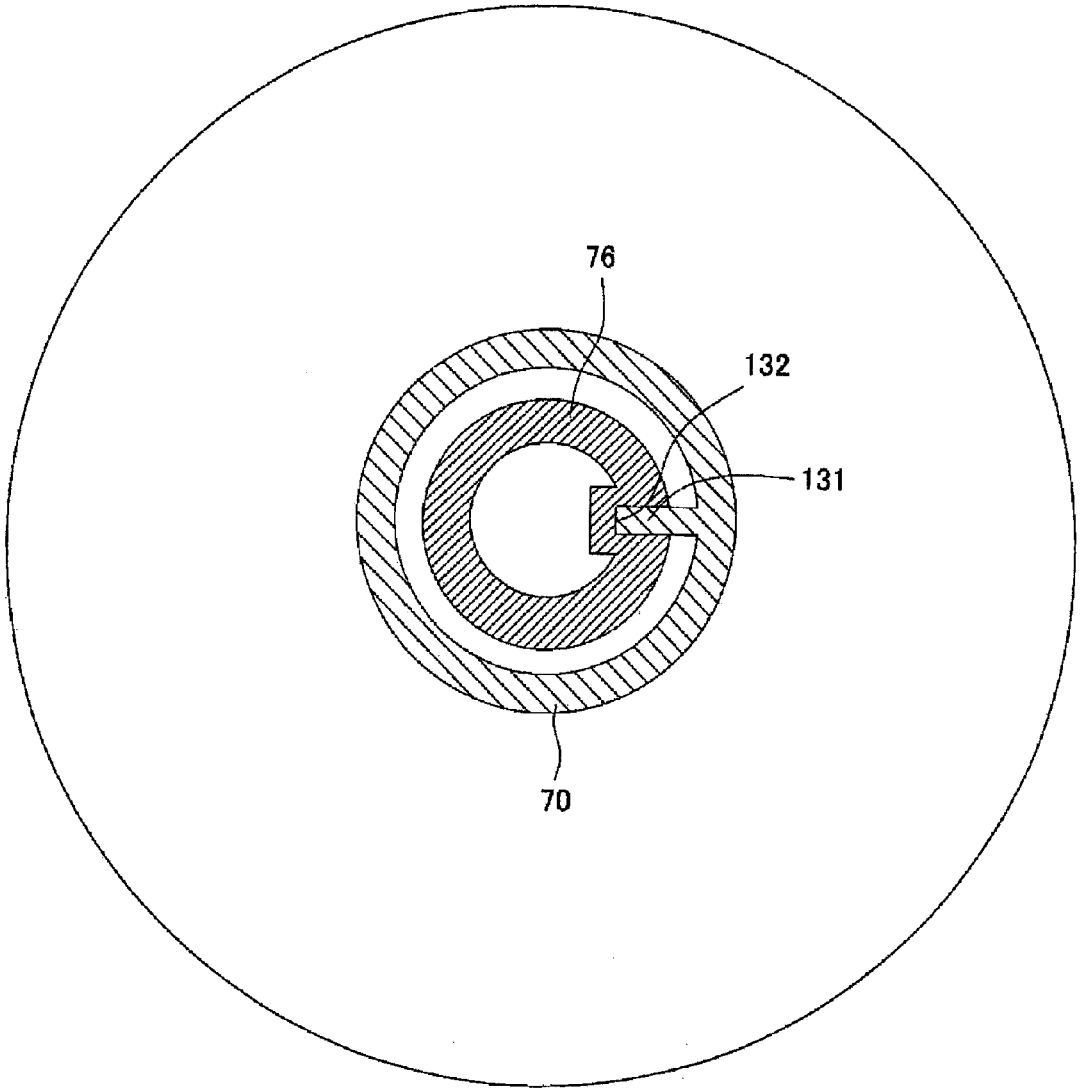
FIG. 20 is a sectional view of a right cylindrical fitting part and a left cylindrical fitting part according to a modification 7.

Further, as illustrated in FIG. 20, a configuration may be employed in which the cross-sectional shape of the opposed part of the right cylindrical fitting part 70 and the left cylindrical fitting part 76 is a circular shape, and one of the right cylindrical fitting part and the left cylindrical fitting part includes a protrusion 131 and the other includes a groove 132 capable of being engaged with the protrusion 131 (modification 7).

Figure 21:
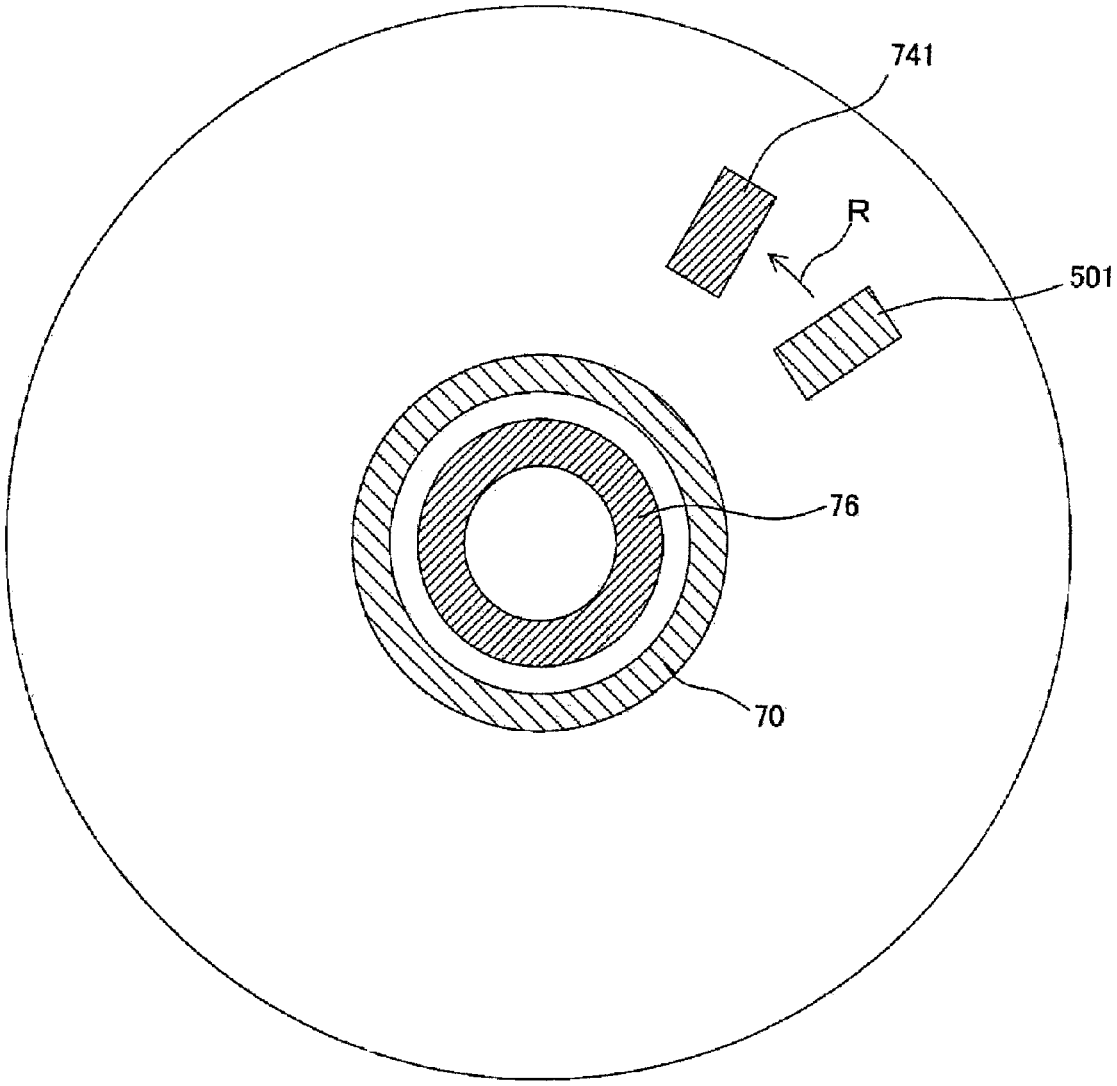
FIG. 21 is a sectional view of a right cylindrical fitting part and a left cylindrical fitting part according to a modification 8.

Further, as illustrated in FIG. 21, a configuration may be employed in which the cross-sectional shape of the opposed part of the right cylindrical fitting part 70 and the left cylindrical fitting part 76 is a circular shape, an engaging part (engaging part 501 on the reset gear 50 and engaging part 741 on the detected rotary member 74) is provided as a separate member different from the right cylindrical fitting part 70 and the left cylindrical fitting part 76, and the reset gear 50 and the detected rotary member 74 are engaged by the engaging part so as not to allow relative rotation therebetween (modification 8).

Specifically, the engaging part 501 on the reset gear 50 has a substantially prismatic shape which extends from the left side of the reset gear 50 to the left in a region radially outward from the right cylindrical fitting part 70.

Further, the engaging part 741 on the detected rotary member 74 has a substantially prismatic shape which extends from the right side of the detected rotary member 74 to the right in a region radially outward from the left cylindrical fitting part 76.

As the engaging part 501 on the reset gear 50 contacts the engaging part 741 from the upstream side of the rotational direction R, the detected rotary member 74 rotates together with the reset gear 50 in the rotational direction R.

5. Modification 9

Figure 22:
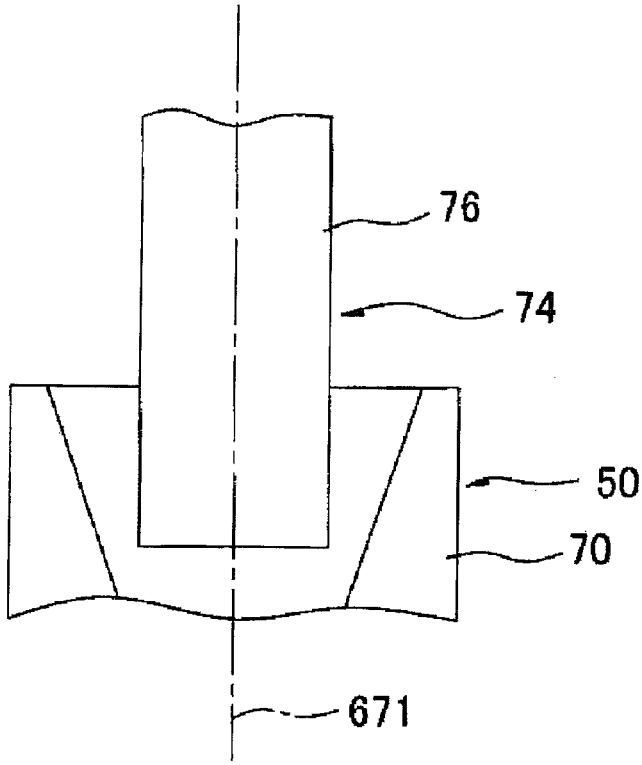
FIG. 22 is a schematic sectional view of a reset gear and a detected rotary member according to a modification 9.

As illustrated in FIG. 22, a space between the right cylindrical fitting part 70 of the reset gear 50 and the left cylindrical fitting part 76 of the detected rotary member 74 may be expanded toward the left. By this configuration, it is possible to secure a large amount of displacement of the detected rotary member 74 in a direction crossing the center axis 671.

6. Modification 10

Figure 23:
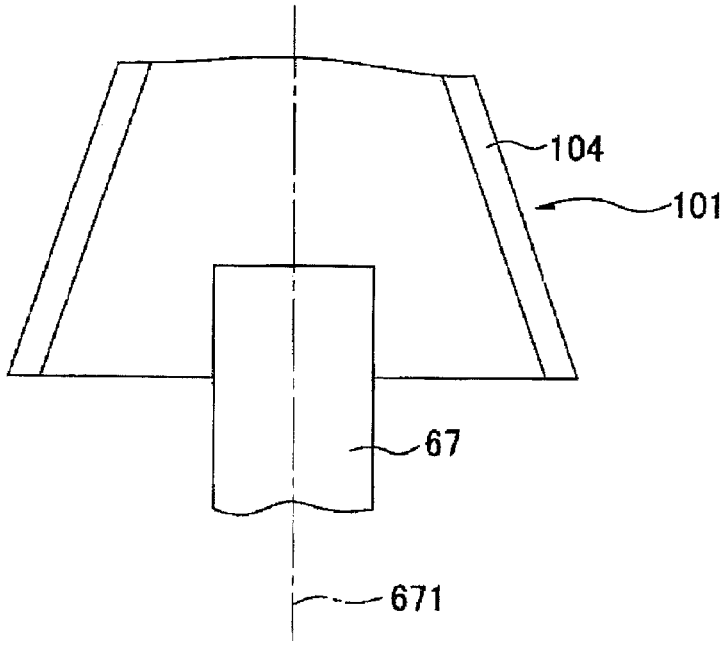
FIG. 23 is a schematic sectional view of a detected gear according to a modification 10.

As illustrated in FIG. 23, a space between the support shaft 67 and the cylindrical fitting part 104 of the detected gear 101 may be expanded toward the right. By this configuration, it is possible to secure a large amount of displacement of the detected gear 101 in a direction crossing the center axis 671.

7. Modification 11

As an example of a cartridge, the developing cartridge 7 which includes the agitator 16 (as an example of a supplying member) having the agitator rotating shaft 62 and the developing roller 18 having the developing roller shaft 57 is employed. However, the cartridge may be a toner cartridge which includes the agitator 16 but does not include the developing roller 18 or a toner cartridge which does not include the agitator 16 and the developing roller 18. Further, instead of the agitator 16, an auger may be used.

8. Modification 12

Figure 24:
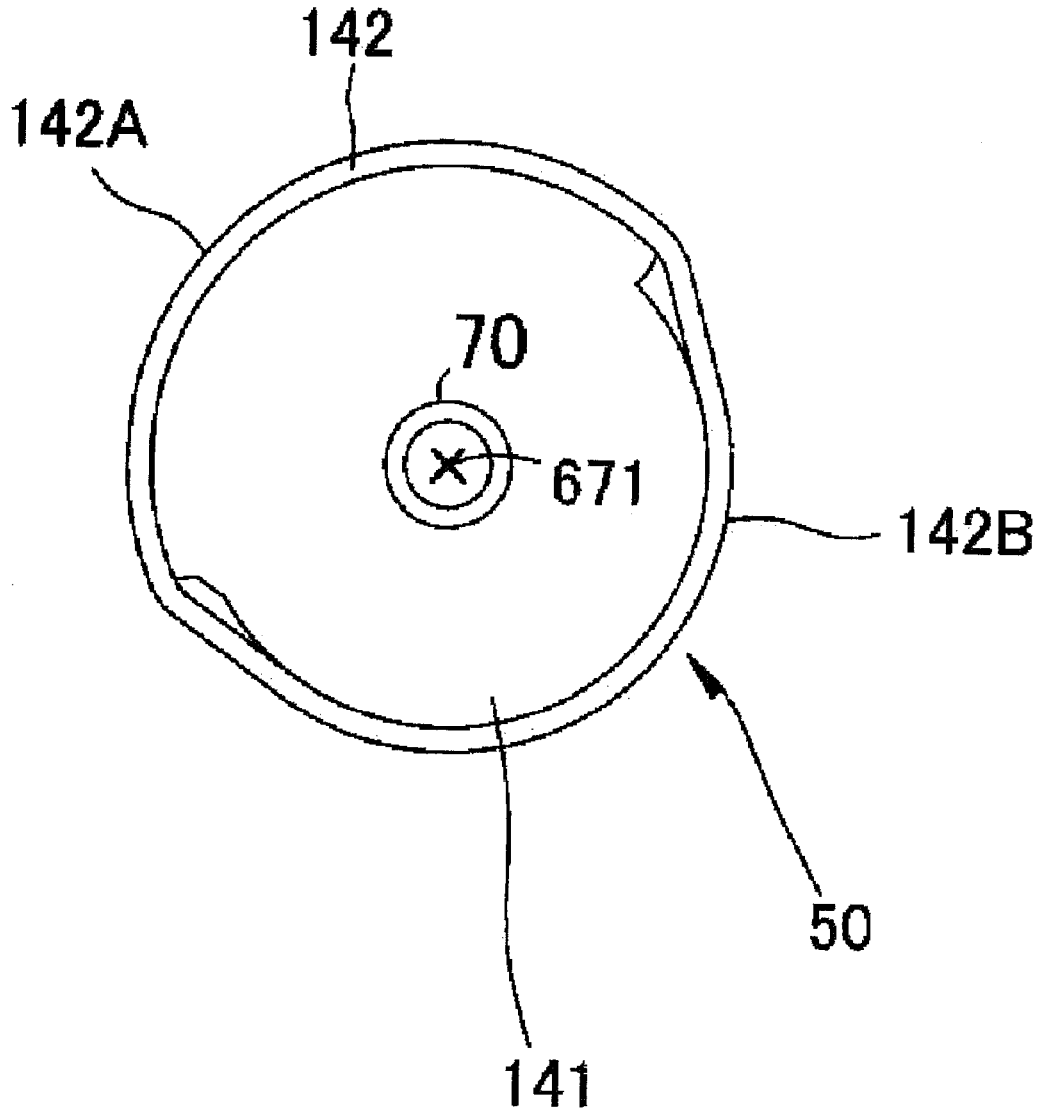
FIG. 24 is a schematic side view illustrating a configuration (modification 12) replacing a teeth missing gear portion of the reset gear.

In each embodiment and each modification, the reset gear 50 includes the teeth missing gear part 71 which has gear teeth 72 at a partial area thereof (an area excluding the teeth missing part 73). However, as illustrated in FIG. 24, for example, a substantially disc-shaped main body 141 around the center axis 671 and a resistance providing member 142 wound around an outer periphery of the main body 141 may be provided, instead of the teeth missing gear part 71. Herein, at least an outer peripheral surface of the resistance providing member 142 is made of a material having a relatively high frictional coefficient such as a rubber. In this case, the small diameter gear part 65 of the agitator gear 49 may include the gear teeth 66 at its peripheral surface or not. Also, one half of the main body 141 is a relatively small diameter part 142B so that the outer peripheral surface of the resistance providing member 142 does not contact the small diameter gear part 65 and the other half of the main body 141 is a relatively large diameter part 142A so that the outer peripheral surface of the resistance providing member 142 contacts the peripheral surface of the small diameter gear part 65.

9. Modification 13

Figure 25:
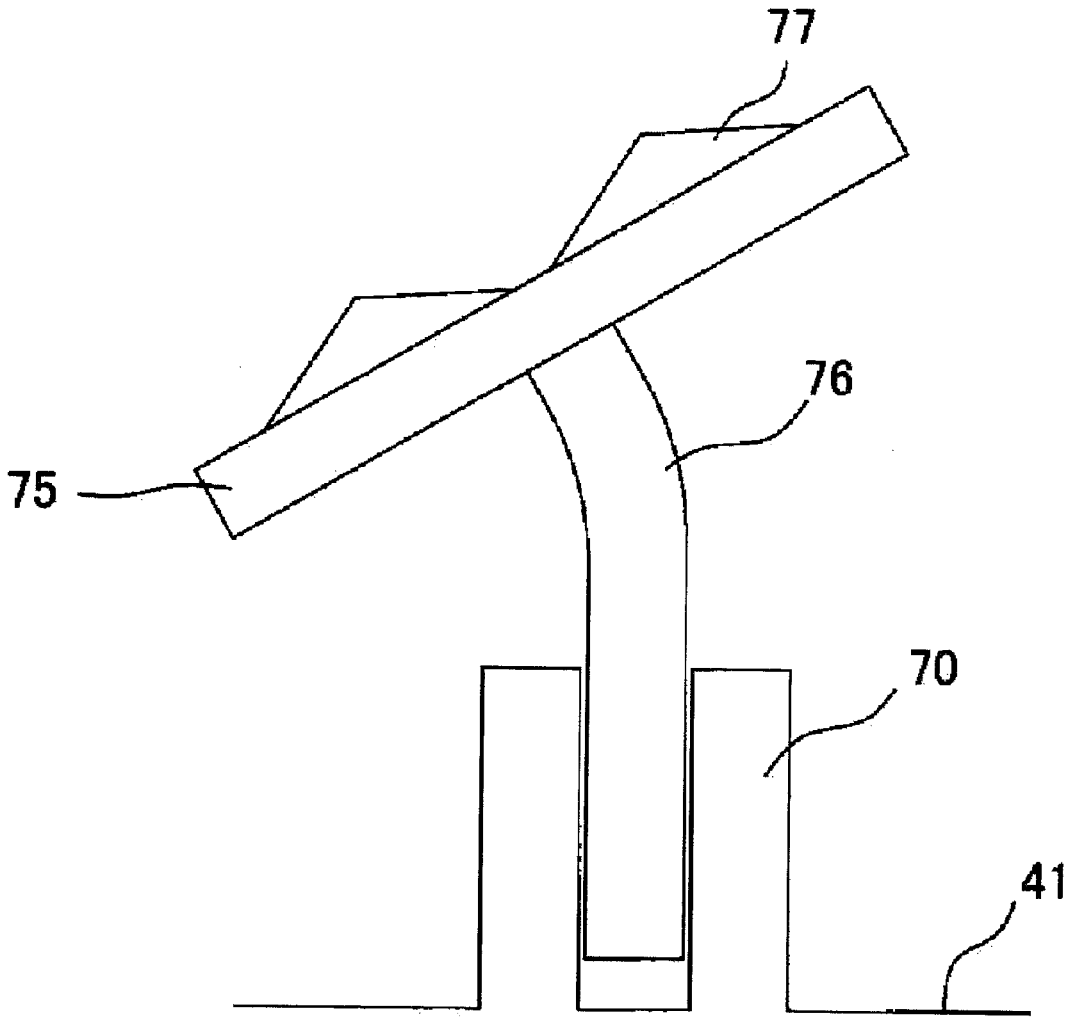
FIG. 25 is a schematic sectional view of a reset gear and a detected rotary member according to a modification 13.

In each embodiment and each modification, the left cylindrical fitting part 76 of the detected rotary member 74 is loosely inserted into the right cylindrical fitting part 70 of the reset gear 50. However, for example, a configuration may be employed in which the left cylindrical fitting part 76 of the detected rotary member 74 is made of an elastically deformable material such as a rubber and fitted into the right cylindrical fitting part 70 of the reset gear 50, as illustrated in FIG. 25.

According to the configuration, as other components contact the detected protrusion part 77 of the detected rotary member 74, the left cylindrical fitting part 76 is elastically deformed and thus a force applied on the detected protrusion part 77 can be relieved.

The above configurations can be variously modified within the scope of appended claims.

What is claimed is:

1. A cartridge comprising:

a housing including a first side wall and a second side wall which are opposed to each other and accommodating developer therein;

a driving input member provided to the first side wall and configured to rotate by a rotational driving force inputted from the outside; and a first rotary member provided at an outer side of the first side wall and configured to rotate about a first rotational axis in response to a rotational driving force from the driving input member, wherein the first rotary member includes a protrusion protruding to the outer side, wherein the first rotary member is configured to be moved relative to the first side wall in a direction along the first rotational axis, and wherein an end portion of the first rotary member at an opposite side of the first side wall is configured to be displaced in a direction crossing the first rotational axis.

2. The cartridge according to claim 1, further comprising a cover attached to the first side wall, wherein the cover includes an opposing part opposed to the first rotary member from the opposite side of the first side wall.

3. The cartridge according to claim 2, wherein the first rotary member includes a first fitting part extending in the direction along the first rotational axis, and wherein the cover includes a first fitted part which is spaced apart and opposed to the first fitting part in a direction perpendicular to the direction along the first rotational axis and the first rotary member is configured to be displaced in the direction crossing the first rotational axis.

4. The cartridge according to claim 1, further comprising a support member provided to the first side wall and configured to rotatably support the first rotary member, wherein the first rotary member includes a second fitting part extending in the direction along the first rotational axis, and wherein the support member includes a second fitted part which is spaced apart and opposed to the second fitting part in a direction perpendicular to a direction along the first rotational axis and the first rotary member is configured to be displaced in the direction crossing the first rotational axis.

5. The cartridge according to claim 4, wherein the second fitting part and the second fitted part are configured to contact with each other at one or two points in one of a first position in the direction along the first rotational axis and a second position different from the first position.

6. The cartridge according to claim 4, wherein a space between the second fitting part and the second fitted part increases toward one side of the direction along the first rotational axis.

7. The cartridge according to claim 1, further comprising a second rotary member provided to the first side wall, wherein the second rotary member is configured to rotate about the first rotational axis and transmit a rotational driving force outputted from the driving input member to the first rotary member, wherein the first rotary member is provided at the opposite side of the first side wall relative to the second rotary member and includes a second fitting part extending in the direction along the first rotational axis, and wherein the second rotary member includes a second fitted part which is spaced apart and opposed to the second fitting part in a direction perpendicular to the direction along the first rotational axis and the first rotary member is configured to be displaced in a direction crossing the first rotational axis.

8. The cartridge according to claim 7, wherein the second fitting part and the second fitted part are configured to contact with each other at one or two points at one of a first position in the direction along the first rotational axis and a second position different from the first position.

9. The cartridge according to claim 7, wherein a space between the second fitting part and the second fitted part increases toward one side of the direction along the first rotational axis.

10. The cartridge according to claim 1, further comprising an elastic member configured to urge the first rotary member in a direction away from the first side wall.

11. The cartridge according to claim 1, wherein an end portion of the protrusion in a rotational direction of the first rotary member is chamfered.

12. The cartridge according to claim 1, further comprising a developing roller, wherein the developing roller includes a rotating shaft extending parallel to the first rotational axis and both ends of the rotating shaft are rotatably provided to the first side wall and the second side wall.

13. The cartridge according to claim 1, further comprising a supplying member, wherein the supplying member includes a rotating shaft extending parallel to the first rotational axis, both ends of the rotating shaft are rotatably provided to the first side wall and the second side wall and the supplying member rotates about the rotating shaft to supply the developer within the housing.

14. A cartridge comprising:

a housing accommodating developer herein the housing including:

a first side wall, and a second side wall which is opposed to a first surface of the first side wall;

a driving input member provided to the first side wall and configured to rotate;

a rotary member opposed to a second surface of the first side wall, which is opposite to the first surface of the first side wall, at a first surface thereof, and configured to rotate about a rotational axis in response to a rotational driving force from the driving input member, the rotational axis being substantially perpendicular to the first side wall; and a protrusion protruding from a second surface of the rotary member, which is opposite to the first surface of the rotary member, wherein the rotary member is configured to be moved relative to the first side wall in a direction substantially parallel to the rotational axis, and wherein the rotary member is configured to be displaced in a direction crossing first rotational axis.

15. The cartridge according to claim 14, further comprising a cover attached to the first side wall, wherein the cover includes a first cover part opposed to the second surface of the rotary member.

16. The cartridge according to claim 15, wherein the rotary member includes a fitting part extending in the direction substantially parallel to the rotational axis, and wherein the cover includes a second cover part which is spaced apart and opposed to the fitting part in a direction substantially perpendicular to the rotational axis so that the rotary member is configured to be displaced in the direction crossing the rotational axis.

* * * * *